US012179090B1

(12) United States Patent
Curley

(10) Patent No.: US 12,179,090 B1
(45) Date of Patent: Dec. 31, 2024

(54) CENTRIFUGAL CARD SHUFFLER

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

(21) Appl. No.: 18/737,984

(22) Filed: Jun. 8, 2024

(51) Int. Cl.
*A63F 1/12* (2006.01)

(52) U.S. Cl.
CPC ..... *A63F 1/12* (2013.01)

(58) Field of Classification Search
CPC ..... A63F 1/12
See application file for complete search history.

(56) References Cited

U.S. PATENT DOCUMENTS

| | | | | |
|---|---|---|---|---|
| 1,885,276 | A | 11/1932 | McKay | |
| 2,026,682 | A * | 1/1936 | Jeffries | A63F 1/10 273/144 R |
| 3,260,520 | A | 7/1966 | Sugden | |
| 3,771,783 | A | 11/1973 | McInerny | |
| 4,586,712 | A | 5/1986 | Lorber | |
| 4,659,082 | A * | 4/1987 | Greenberg | A63F 1/12 273/149 R |
| 4,770,421 | A | 9/1988 | Hoffman | |
| 5,989,122 | A * | 11/1999 | Roblejo | A63F 1/14 463/47 |
| 6,149,154 | A | 11/2000 | Grauzer | |
| 6,267,248 | B1 | 7/2001 | Johnson | |
| 7,261,294 | B2 | 8/2007 | Grauzer | |
| 7,338,044 | B2 | 3/2008 | Grauzer | |
| 7,500,672 | B2 | 3/2009 | Ho | |
| 7,753,374 | B2 | 7/2010 | Ho | |
| 7,766,333 | B1 | 8/2010 | Stardust | |
| 7,900,923 | B2 | 3/2011 | Toyama | |
| 7,900,924 | B2 | 3/2011 | Ho | |
| 8,267,404 | B2 | 9/2012 | Grauzer | |
| 8,342,525 | B2 | 1/2013 | Scheper | |
| 8,342,526 | B1 | 1/2013 | Sampson | |
| 8,353,513 | B2 | 1/2013 | Swanson | |
| 8,419,016 | B2 | 4/2013 | Yoseloff | |
| 8,544,848 | B2 | 10/2013 | Blaha | |
| 8,590,896 | B2 | 11/2013 | Krenn | |
| 8,651,486 | B2 | 2/2014 | Grauzer | |
| 8,702,100 | B2 | 4/2014 | Snow | |
| 8,931,779 | B2 | 1/2015 | Grauzer | |
| 9,126,103 | B2 | 9/2015 | Krenn | |
| 9,474,957 | B2 | 10/2016 | Haushalter | |
| 9,623,317 | B2 | 4/2017 | Scheper | |
| 9,717,979 | B2 | 8/2017 | Grauzer | |
| 2002/0017481 | A1 * | 2/2002 | Johnson | B07C 5/34 463/16 |

(Continued)

*Primary Examiner* — Michael D Dennis
(74) *Attorney, Agent, or Firm* — Chris Tanner; BlueCollarIP.com

(57) ABSTRACT

A card handling apparatus and method of manufacture and assembly is used for creating pre-formed hands for use in casino poker games whereupon the apparatus may be programmed to accommodate a number of different game variations, and a number of players is disclosed. The apparatus comprises an unshuffled card input portal, a shuffled card discharge portal and a radial card receiver whose operation utilizes centrifugal force. The exploitation of centrifugal force allows the apparatus to be operated without the need for the motorized pusher mechanisms which are prevalent in the prior art, thus creating a shuffler that is more compact and requires less manufacturing cost.

4 Claims, 17 Drawing Sheets

(56) References Cited

U.S. PATENT DOCUMENTS

| | | | | |
|---|---|---|---|---|
| 2013/0020761 | A1* | 1/2013 | Sines | A63F 1/12<br>273/149 R |
| 2024/0009547 | A1 | 1/2024 | Oeding | |

* cited by examiner

FIG. 18
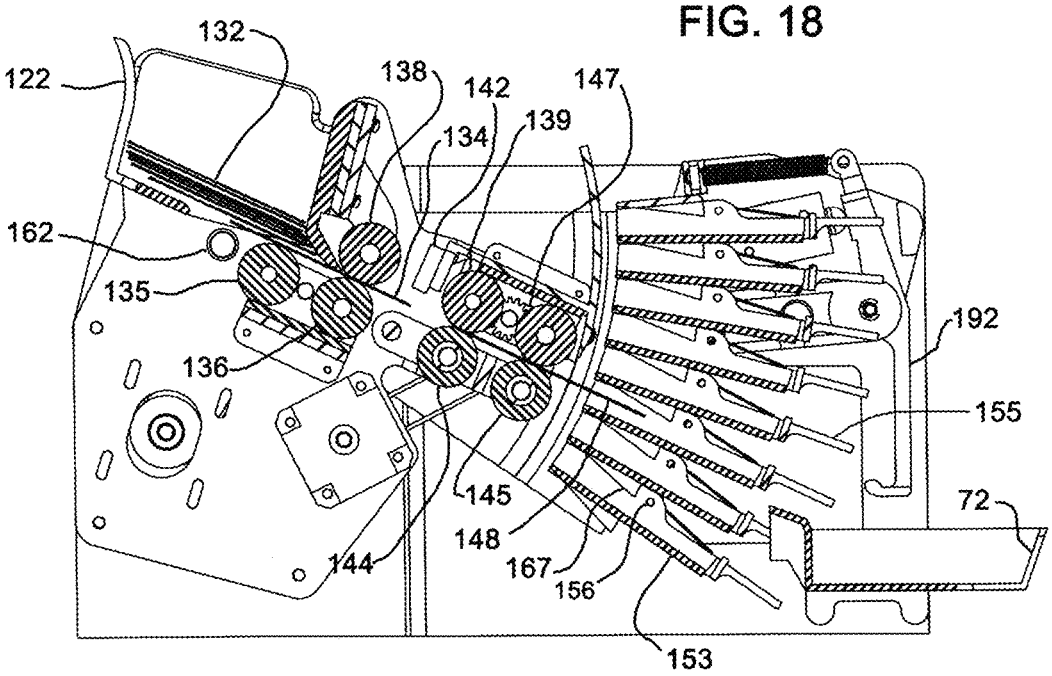
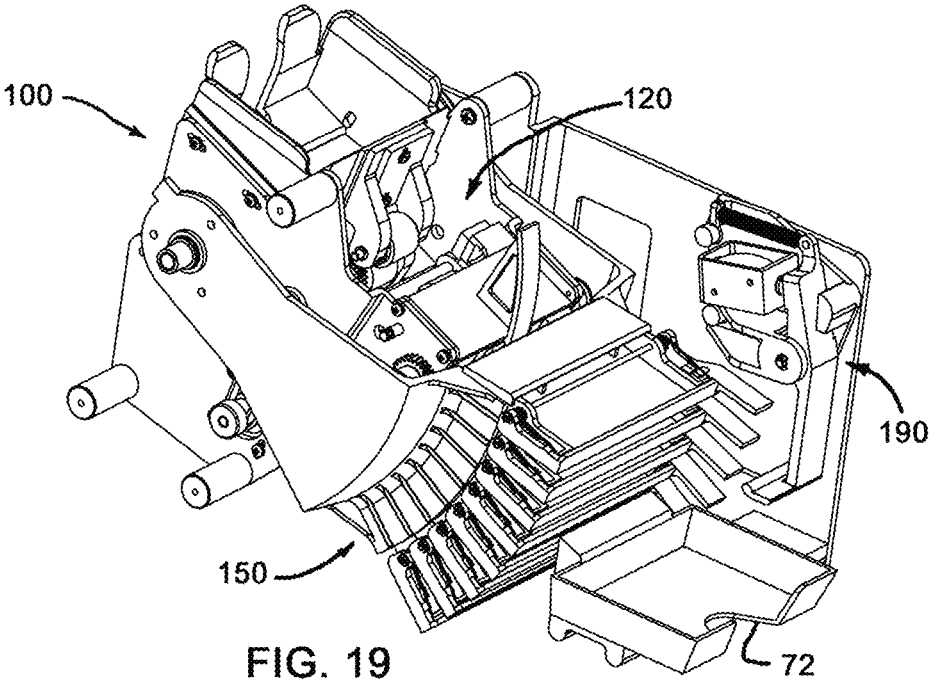
FIG. 19

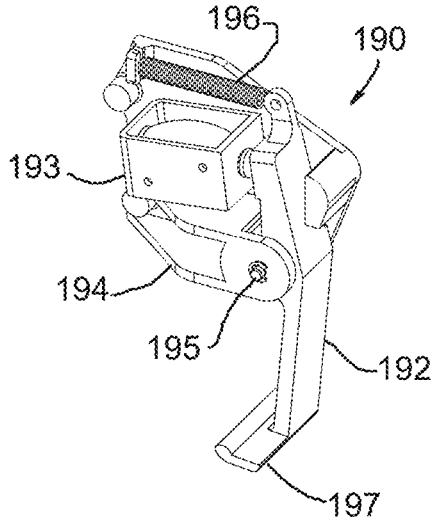
FIG. 20A
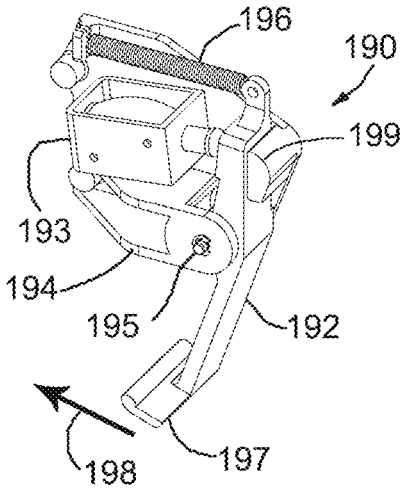
FIG. 20B
FIG. 21
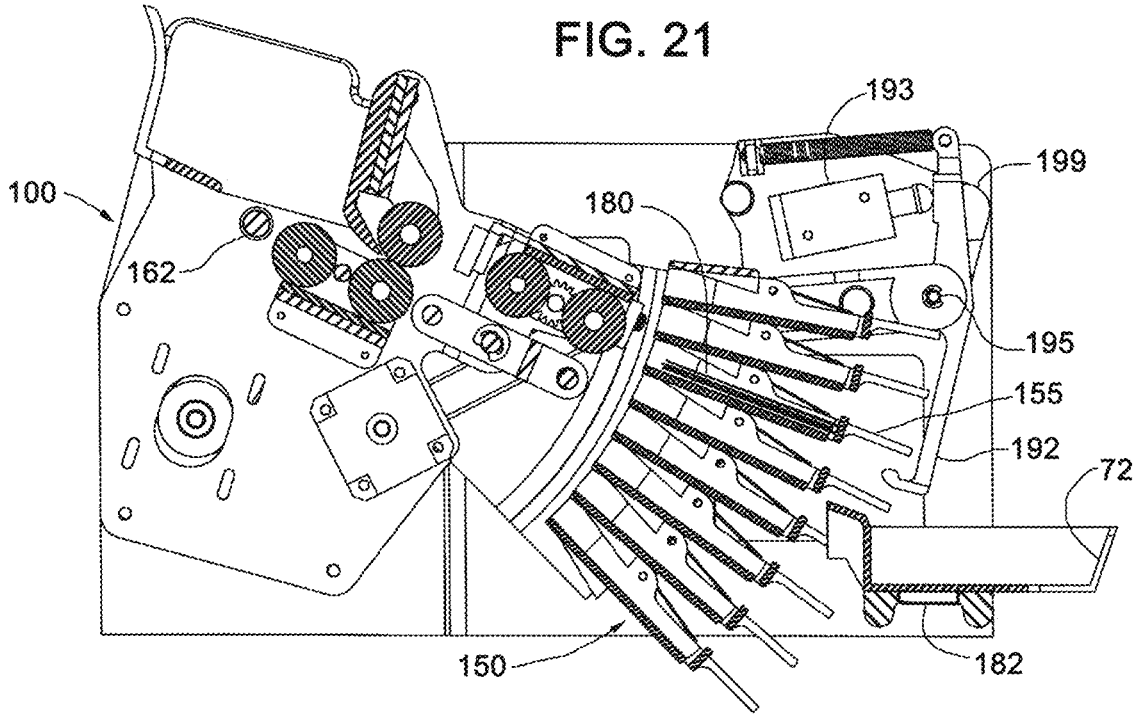

CENTRIFUGAL CARD SHUFFLER

FIELD OF INVENTION

The present invention is related to the field of casino grade automatic card shuffling machines, which are used by casinos to speed up the rate of play of dealer-hosted card games. More particularly, the invention relates to shuffling machines which randomize the rank and suit of cards within a single deck of playing cards in order to form "hands" for use in various types of poker games. These shuffler types are called "hand forming" shufflers in the art because they dispense groups of play-ready cards to an exit portal, whereupon a casino dealer issues one shuffled hand to each player at the initiation of a poker game. The groups of play-ready cards are herein referred to as "substacks".

BACKGROUND

Stud poker games such as Let it Ride®, Three-Card Poker®, or Caribbean Stud® are major attractions in casino poker rooms because they are relatively easy to play and allow wagering to various degrees of risk. A single deck of 52 playing cards is used in these games, which must be periodically shuffled to effect randomness of the rank and suit of the individual cards within the deck. Each poker game is initiated by delivering a shuffled (randomized) hand of playing cards to each game participant. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

"Hand-forming" shufflers quickly randomize card decks and sort them into shuffled substacks within compartments which reside within the apparatus. Upon dealer request, each substack is delivered to an exit portal where a dealer may issue that hand to a player. The hand-forming shufflers are programmable such that the number of cards in each substack may be adjusted for individual card games, and for the number of players. For example, various forms of five-card stud poker will be initiated with hands of 5 cards, while games such as Three-Card Poker® are played with hands of only three cards.

FIG. 1 illustrates an early "hand-forming" playing card shuffler that was described in a 1932 patent granted to R. C. Mckay and issued as U.S. Pat. No. 1,885,276 (Mckay '276). Groups of individual playing cards are accumulated into substacks in four compartments which are configured radially in a rotating carrier. FIG. 1 is reproduced from the Mckay '276 patent which explains that individual cards are separated from an unshuffled deck and randomly accumulated into four compartments. The substacks of cards are retained in each compartmental nest by gravity, and the substacks must be removed from their nests by displacing the card carrier so that the cards may be removed in the same direction from which they were inserted.

Referring to FIG. 1, the rotational housing which carries the four compartments is called the "receiver" 1024, which possesses four compartments 1025 thru 1028 for accumulating substacks of randomly selected cards. The receiver 1024 rotates about pivot 1032 to one of four randomly chosen radial positions. A deck of cards is placed into the magazine 1001 which utilizes rubber tired wheels 1003 to strip individual cards from the bottom of the stack and move them through a slotted opening 1050 under the power of a hand crank. An innovative random selection mechanism using small balls of four sizes is used to randomly position the receiver 1024 to one of four radial positions for collecting the individual cards into compartments 1025 thru 1028.

Mckay '276 appears to have pioneered the concept of "shuffling" cards by distributing individual cards randomly into a myriad of compartments. Indeed, the 1932 patent is entitled AUTOMATIC CARD SHUFFLER AND DEALER, and teaches an innovative randomizing configuration which was implemented without the aid of motors or microcontrollers.

A later shuffler patent is known in the industry as the "Lorber Design" and was taught by U.S. Pat. No. 4,586,712 (Lorber '712), which was granted in 1986. This classic configuration (shown in FIG. 2) is based upon unloading cards from an unshuffled deck into the individual slots of a carousel, randomly rotating the carousel, and then pushing individual cards from the carousel slots and into a shoe. Each slot in the Lorber '712 carousel holds one card.

As shown in the upper section of FIG. 2, an unshuffled card stack 2053 is deposited on edge into container 2052 of the automatic shuffling apparatus 2050. Individual cards are vertically stripped from the stack and moved downward from the left end of container 2052 and into a carousel 2062 by driven rollers 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within the carousel 2062. Individual cards are extracted from the randomly rotated carousel 2062 at the station shown in the bottom left section of the figure by the action of an "ejecting device" 2066. Driven rollers 2054 and 2055 move the individual cards into a newly created stack within the space 2068. The stack of cards within discharge portal 2068 has thus been arranged randomly (shuffled).

Rather than arranging the card storage compartments within a circular carousel, other early shufflers utilized compartments configured in a vertical stack. 1988 U.S. Pat. No. 4,770,421 to Lionel Hoffman (Hoffman '421) teaches a stack of "mixing pockets". Referring to FIG. 3A, which is reproduced and annotated from that patent, the six mixing pockets 934A through 934F are arranged in a linear stack. The Hoffman '421 specification explains that cards are individually inserted into a randomly chosen compartment within the stack of mixing pockets, accumulated, and then extracted in groups from the mixing pockets in a random order. The specification explains;

According to a more particular form of the invention, a card shuffler is provided comprising a plurality of mixing pockets for holding cards, and card holding and distribution means for holding a stack of cards and for distributing and transferring one card at a time in sequence to said mixing pockets in accordance with a first distribution schedule. (Hoffman '421 1:61-67)

The compartment shuffler art has since generally evolved into myriads of disclosures that are characterized by their storage compartment configurations. A large group of more recent shuffler disclosures utilize linear stacks and elevators, and another large group of more recent disclosures utilize circularly-arranged storage exemplified by drums and carousels.

A more recent "hand-forming" shuffler is taught by U.S. Pat. No. 6,659,460 which was granted in 2003 to Ernst Blaha (Blaha '460), as shown in FIG. 3B. Blaha '460 also incorporates a carousel configuration which is similar to the Lorber design, but Blaha '460 differs from its predecessor by configuring the carousel slots to accumulate multiple cards. In this way, Blaha is used as a hand forming shuffler.

Referring to FIG. 3B, unshuffled cards 313 residing in an unshuffled card station 310 (upper left) are transported by feed rollers 314, 315, 318 and 319 into compartments 369 of the "rotatably held drum" 302. The rollers 318 and 319 are unable to fully insert the cards into the compartments, thus requiring a first pusher 316 which is driven by a motor 323 through eccentric link 322. The pusher 316 pushes each card through the final small movement into the compartments 369 of the drum 302. The drum is rotated by motor 308 to random loading positions as commanded by a microprocessor such that each compartment may accumulate a series of randomly selected cards.

The drum compartments are unloaded to a second station 342 by a second pusher linkage 335 and 337 which is actuated by a motor-driven eccentric 338. After each card is pushed sufficiently into the friction rollers 340 and 345, those rollers move the cards to the "card storage means" 342, as driven by motor 341. Blaha '460 uses two motors to insert each card into the drum, and another two motors to extract the substacks.

The Blaha '460 drum must rotate through several rotation cycles to accumulate substacks, and then must rotate again to disgorge those substacks. While rotating, the substacks of playing cards in each compartment of the Blaha '460 carousel are subjected to centrifugal forces which try to propel the cards outwardly from their compartments during each excursion. The magnitude of the centrifugal forces is dependent upon the acceleration used to rotate the drum 302.

Blaha teaches that the substacks are retained in opposition to the centrifugal force by clamping the stacks with springs which are provided within each compartment of the carousel. FIG. 4 shows the leaf springs 351 and 353 as reproduced from the '460 patent figures. The disclosure explains that the "springs insure the clamping of the card(s) inserted into the respective compartments" ('460 4:13-14).

The acceleration used for rotation of the Blaha '460 drum is limited by the clamping force of the springs. FIG. 5 illustrates the physics of the clamping force. This vector diagram explains that the retaining spring 501 must exert sufficient force against the face of the cards to counteract the centrifugal force. Referring to FIG. 5, a card substack 5005 is shown resting on the floor 5007 of a compartment of a carousel that rotates about axis 5008. The arrow 5010 represents the angular acceleration which imposes a centrifugal force $F_C$ upon the card substack 5005. A resistance force $F_R$ must be created by the spring 5001 to counteract the centrifugal force and prevent the card stack from flying out of the compartment. The spring acts upon a bearing pad 5003 which bears against the surface of the stack. The resistance force is given by:

$F_R=\mu N$ where: $\mu$ is the friction coefficient between the bearing pad and the cards N=normal force imposed by the spring which is $F_S$ Thus, $F_R=\mu F_S$ For equilibrium, the resisting force $F_R$ must at least balance the centrifugal force $F_C$:

$$F_C=F_R=\mu F_S$$

Since playing cards are intentionally designed to have slippery surfaces, the friction coefficient between cards in a stack is relatively small. This small friction coefficient exacerbates the clamping friction problem. As seen by the clamping equation, a relatively large spring force must be used to counteract centrifugal force when the friction coefficient is small. Conversely, the spring force is limited by the force required to push the cards into the substack during loading of the compartment.

The magnitude of the retaining spring clamping force requires that the Blaha device uses a first motorized "pusher" mechanism to insert cards into the compartments and a second motorized pusher mechanism to extract the cards from the compartments. These pusher mechanisms, which push against the edge of each card, are required to overcome the clamping forces imposed by the retaining springs in each compartment as each card is slid into the pre-existing stack. One of ordinary skill recognizes that those two motorized "pusher" mechanisms would not be necessary if the substacks were held loosely in each compartment of the Blaha '460 carousel and retained in the direction of the centrifugal force.

The response time of the Blaha shuffler is also limited by its own carousel configuration. The carousel must rotate approximately 180 degrees for moving any card from the input portal to the output portal. Additionally, the rotational acceleration is limited by the clamping force able to be exerted upon the uppermost card in each stack by the retaining springs. The relation between clamping force and rotational acceleration is thus a design compromise which places an upper limit on carousel acceleration. As will be seen herein, centrifugal force can be advantageously utilized in a card shuffler, rather than being problematic as in the Blaha configuration.

Another rotational shuffler is taught by U.S. Pat. No. 7,500,672 (Ho '672) which uses a "shuffling wheel" which appears to be similar to the classic Lorber '712 carousel. FIG. 6 illustrates an isometric view of the disclosure which was granted in 2008 and whose inventor is listed as Cai-Shiang Ho. Unshuffled cards are moved from a "card input device" 6221 into the slots of a "shuffling wheel" 6100 by a series of feed rollers.

FIG. 7 shows a side view from Ho '672 which illustrates the shuffling wheel 6100 and card input device 6221. The card substacks are clamped into the card slots 6012 by coil springs 6121 so as to prevent outward propulsion by centrifugal force. Since the cards are clamped into the wheel slots, motorized "pusher" mechanisms must be used to overcome the clamping forces while inserting and extracting the cards from the wheel slots.

A lever 6024 is shown mounted to the shaft of motor 6025 in FIG. 7 adjacent to the entry of the card feeding roller 6011 at the entry to the shuffling wheel 6100. Ho '672 describes the lever 6024 in the passage which is paraphrased below, where the label numerals from the original reference are modified to reflect the equivalent labels used herein.

> the lever (6024) is mounted in the card-input device (6221) adjacent to the shuffling device (6100) and is connected to and is rotated by a control motor (6025). The control motor (6025) rotates the lever (6024) to push a card conveyed toward an end of the inlet passage. Therefore, the card is completely pushed into the shuffling device (6100). ('672 4:26-32)

Similarly, the arm 6180 and motor 6183 shown in FIG. 7 are used to push the substacks out of the slots 6012. The '672 specification explains;

> The arm (6185) aligns with one of the card slots (6012) of the shuffling wheel (6100) and discharges the card stored in the corresponding card slot (6012). ('672 5:20-23)

It is observed that the two motorized pusher mechanisms are the consequence of the retaining springs that are used to clamp the substacks into the radial slots. If the substacks could be retained loosely within the slots, then the insertion and extraction could be performed by natural forces such as gravity or centrifugal force. The elimination of the two motorized "pusher mechanisms" and the myriad of clamping springs could then substantially reduce the shuffler's manufacturing cost.

U.S. Pat. No. 6,149,154 was granted to Attila Grauzer et al in 2000 (Grauzer '154) and describes another "hand-forming" shuffler where the carousel compartments are unwound into the form of a linear elevator. The elevator consists of card accumulation compartments which are moved linearly rather than rotationally. FIG. 8 shows an illustration reproduced from the '154 patent showing the side view of the device, including the "hand receiving platform" 836, the "card moving mechanism" 830, the "rack assembly" 828, and the card receiver 826 "for receiving a group of cards for being formed into hands". Operation is understandingly similar to the carousel devices. Cards are randomly inserted into slots of the elevator at one station, and thereafter randomly pushed from slots at another station. Cards cannot be moved directly from the input portal to the discharge portal.

Referring to FIG. 8, Grauzer '154 teaches an elevator with nine compartments called a "rack assembly" which traverses up and down in direction of arrow 884. Unshuffled card decks are placed into the unshuffled card receiver 826 against the surface 870 of a moveable block 868, and individually propelled in direction of arrow 882 by motorized rollers 850, 862 and 864 into the compartments of the rack assembly 828 at the loading station 830. An elevator motor 842 and timing belt 840 move the rack assembly upwards and downwards to align randomly chosen compartments with arrow 882. Thereafter, each card is inserted into a randomly chosen compartment and temporarily accumulated with others. A microcontroller counts the number of cards inserted into each randomly chosen compartment. When a given compartment reaches the capacity of cards required for a hand, no more cards are entered into that compartment, and the compartment is considered ready.

When enough compartments are filled to the hand capacity needed for the number of players, the shuffler is then ready to disgorge substacks (hands). A pusher mechanism 890 is located at a lower station and used to push the substacks out of the compartments in the direction of arrow 886 and into the "hand receiving platform" 836. In comparison to the carousel shuffler designs, Grauzer '154 teaches that only nine (9) compartments are required for proper randomization in a hand forming shuffler.

In the Grauzer '154 configuration, the substacks are retained within each elevator compartment by gravity. Thus, a motorized "pusher mechanism" is needed for removing the substacks from the elevator compartments to the hand receiving platform 836. FIG. 9 is a reproduction from another figure of the Grauzer '154 patent that explains the card removal pusher mechanism in more detail. The elevator positions the compartment requiring extraction at a level occupied by a "pusher' mechanism as aligned with arrow 886. The substacks are thereafter pushed out of the compartment 892 allowing the substack to fall by gravity into the hand receiving platform 836. Grauzer '154 describes the pusher 890 as a "rack". The passage below paraphrases a section of the Grauzer disclosure where the label numerals are altered to the equivalent labels used herein.

> The pusher 890 includes a substantially rigid pusher arm in the form of a rack having a plurality of linearly arranged apertures along its length. The arm 890 operably engages the teeth of a pinion gear 896 driven by an unloading motor 898, which is in turn controlled by the microprocessor. At its leading or card contacting end, the pusher arm 890 includes a blunt, enlarged card-contacting end portion. ('154 12:56-67)

Grauzer '154 describes the well-known commercialized "hand forming" shuffler manufactured by ShuffleMaster, called the ACE Shuffler®. The elevator is referred to as a "rack assembly" in the disclosure and consists of eight "hand forming" compartments and a ninth oversized compartment for accumulating the unused cards which remain after all of the required hands have been formed. The oversized compartment is located centrally within the elevator and indicated by label 894 in FIG. 9. The disclosure explains that eight compartments are sufficient for statistical randomization of a deck (52 cards) in the following paraphrased passage.

> Preferably, the rack assembly 828 has nine compartments. Seven of the nine compartments are for forming player hands, one compartment forms dealer hands and the last compartment 894 is for accepting unused or discard cards. It should be understood that the device the present invention is not limited to rack assembly with seven compartments. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. ('154 8:66-67, 9:1-10)

The oversized compartment 894 shown in FIG. 9 is required to collect the unused cards from the unshuffled card receiver. The unused cards must be temporarily stored in the rack assembly because there is no direct path from the unshuffled card receiver to the hand receiving platform. That problem is resolved by the centrifugal shuffler being disclosed herein, which eliminates the need for an oversized card storage compartment.

Machine designers who design electromechanical products are often tasked with the goal of redesigning a product with the specific goal of reducing manufacturing costs. In this way, that product can become more competitive in the marketplace. Such goals require reducing the number of parts and especially reducing the number of motors. Motor-driven mechanisms are attractive targets in cost reduction efforts because such mechanism are surrounded by significant cost burden including home sensors, motor driver chips and software overhead, in addition to the significant cost burden of the motor itself. In the specific case of cost reducing shuffling machines, the designer will seek to reduce the number of motor driven mechanisms and also to reduce the number of compartments. Secondary cost reductions will accrue from shrinking printed circuit board size and reducing the overall size of the product, which reduces the cost of the structural frames and outer jacketing.

The centrifugal shuffler described herein is intended to introduce a more competitive hand-forming shuffler than those which are referenced in the prior art, by achieving discernable manufacturing cost reductions. The shuffler design within this disclosure achieves these manufacturing cost reduction goals by eliminating the need for motorized pusher mechanisms and reducing the number of required compartments, thus achieving a hand-forming shuffler device that requires less parts, is more compact and is more economical to manufacture than the referenced prior art. For example, the Grauzer '154 disclosure (ShuffleMaster ACE® Shuffler) describes the need for five motors and one solenoid ('154 Column 16, Appendix A). Comparatively, the centrifugal shuffling device herein requires only three motors and one solenoid in the preferred embodiment.

The device herein advantageously utilizes centrifugal force to retain and align the card substacks in radially-configured nests, thus eliminating the need for clamping devices and motorized pusher mechanisms, and allowing faster rotational excursions (higher acceleration) during the randomized distribution of cards from the input portal to the temporary storage nests. The shuffler described herein also allows cards to be moved directly from the input portal to the output portal without requiring temporary storage within the radial nests, a feature which has multiple advantages.

The unique features and cost efficiency advantages of the centrifugal shuffler will become better understood with reference to the descriptions, drawings and claims which are presented below.

BRIEF DESCRIPTION OF THE DRAWINGS

FIG. 18 is a side elevation section view of the preferred embodiment shuffler.

FIG. 19 is a perspective view of the preferred embodiment shuffler.

FIG. 20A is a perspective view of the interposer mechanism at rest.

FIG. 20B is a perspective view of the interposer mechanism at actuation.

FIG. 21 is a side elevation view showing the preferred embodiment in its "pre-launch" state.

DETAILED DESCRIPTION

Figure 1:
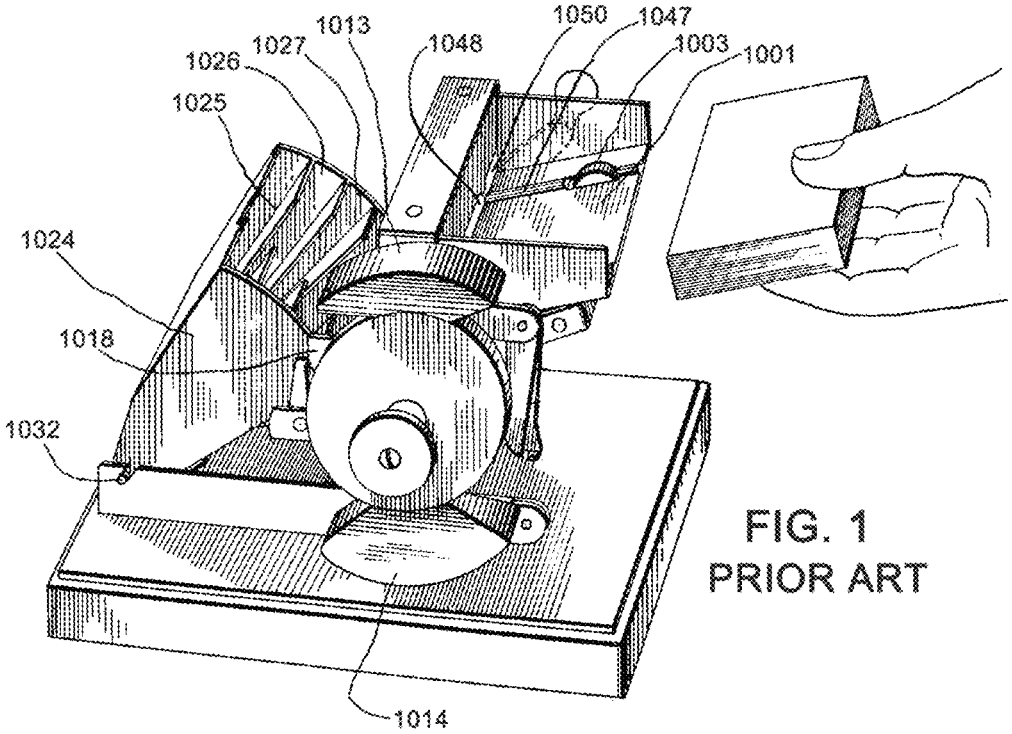
FIG. 1 PRIOR ART
FIG. 1 is a perspective view from an early (1932) hand-forming shuffler patent.
Figure 2:
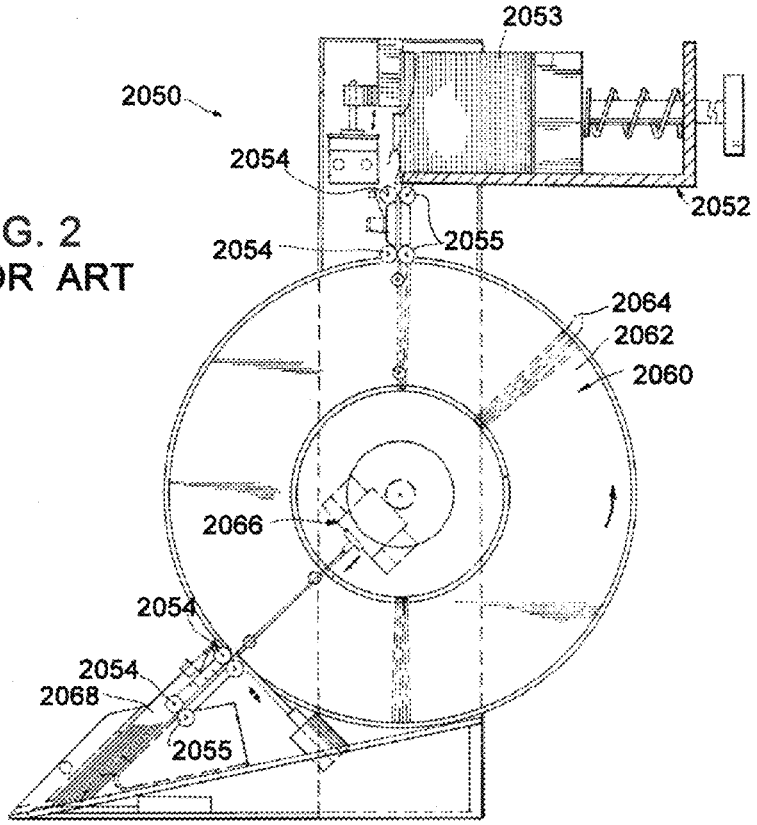
FIG. 2 PRIOR ART
FIG. 2 is a perspective view from a prior art (1986) carousel shuffler patent disclosure.
Figure 3A:
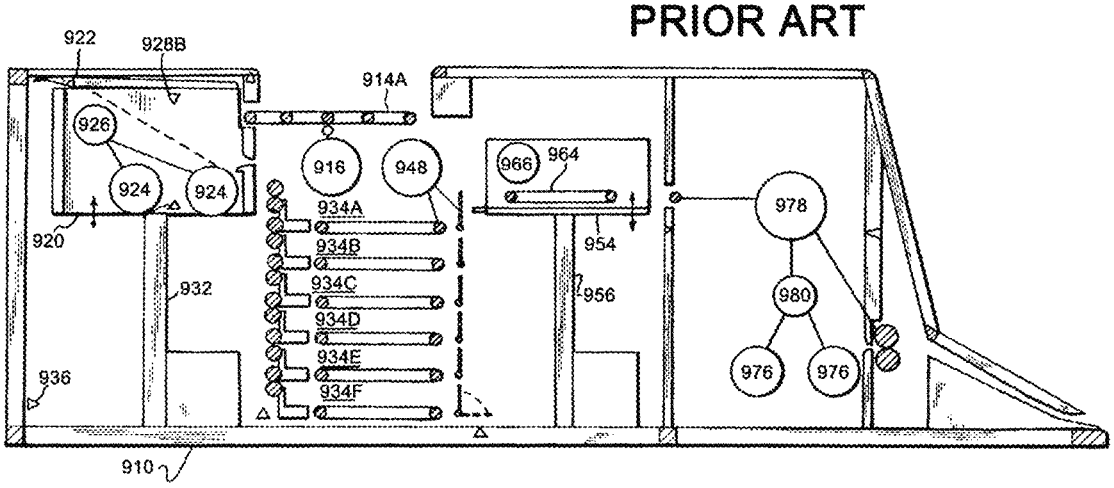
FIG. 3A PRIOR ART
FIG. 3A is a side elevation view from a prior art (1988) elevator shuffler patent disclosure.
Figure 3B:
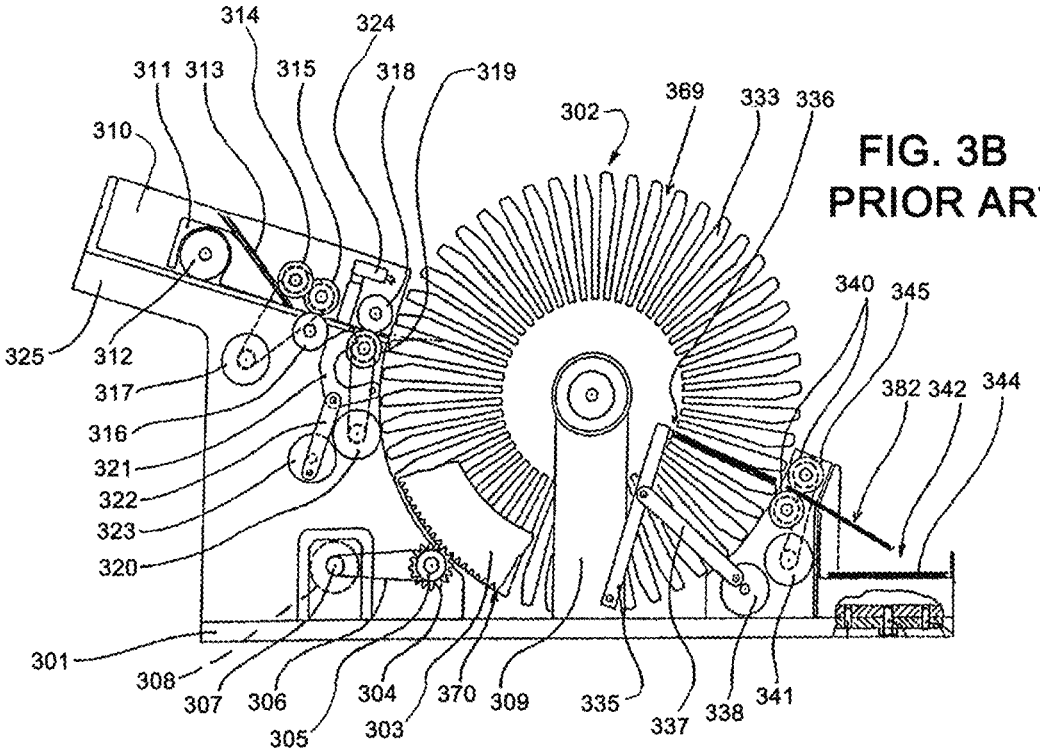
FIG. 3B PRIOR ART
FIG. 3B is a side elevation view from a prior art (2003) carousel shuffler patent disclosure.
Figure 4:
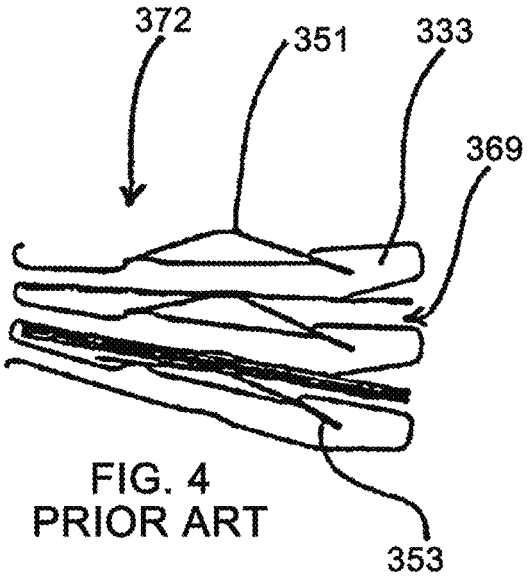
FIG. 4 PRIOR ART
FIG. 4 is a view of a clamping means from the prior art carousel shuffler patent disclosure in FIG. 3.
Figure 5:
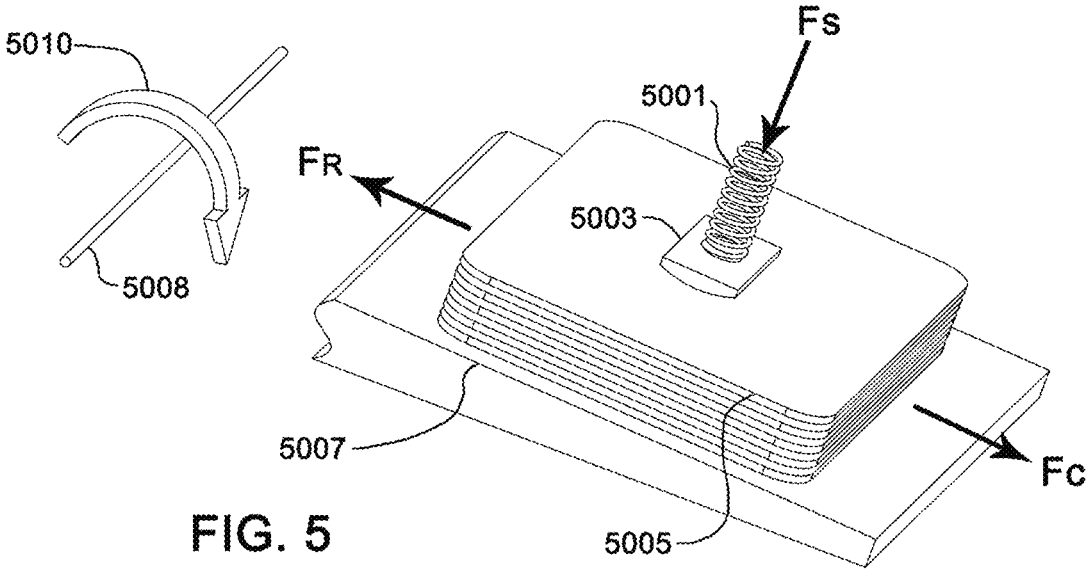
FIG. 5 is a diagram explaining the physics of the carousel clamping forces.
Figure 6:
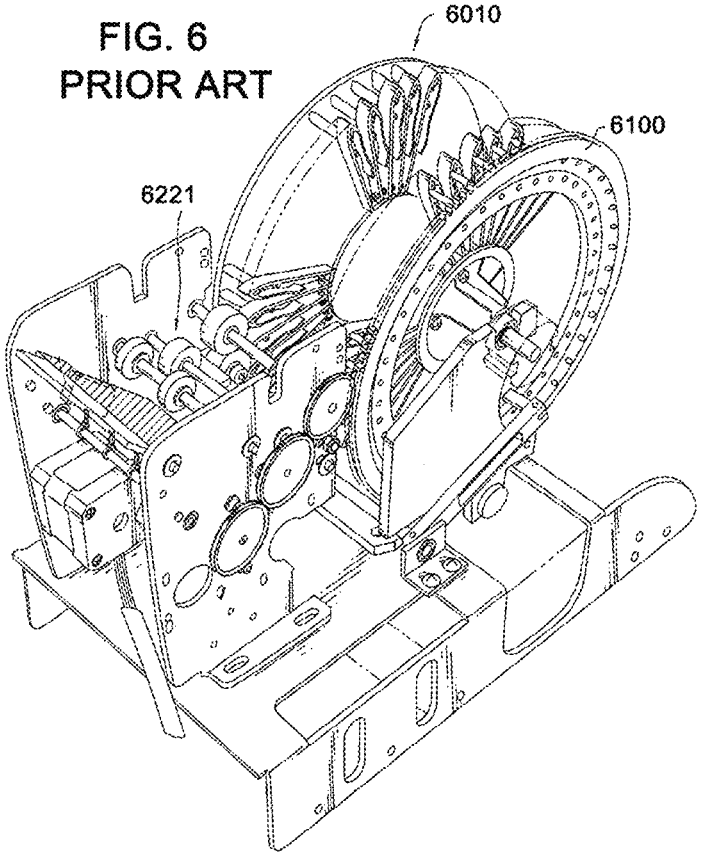
FIG. 6 PRIOR ART
FIG. 6 is perspective view from another prior art (2009) carousel shuffler patent disclosure.
Figure 7:
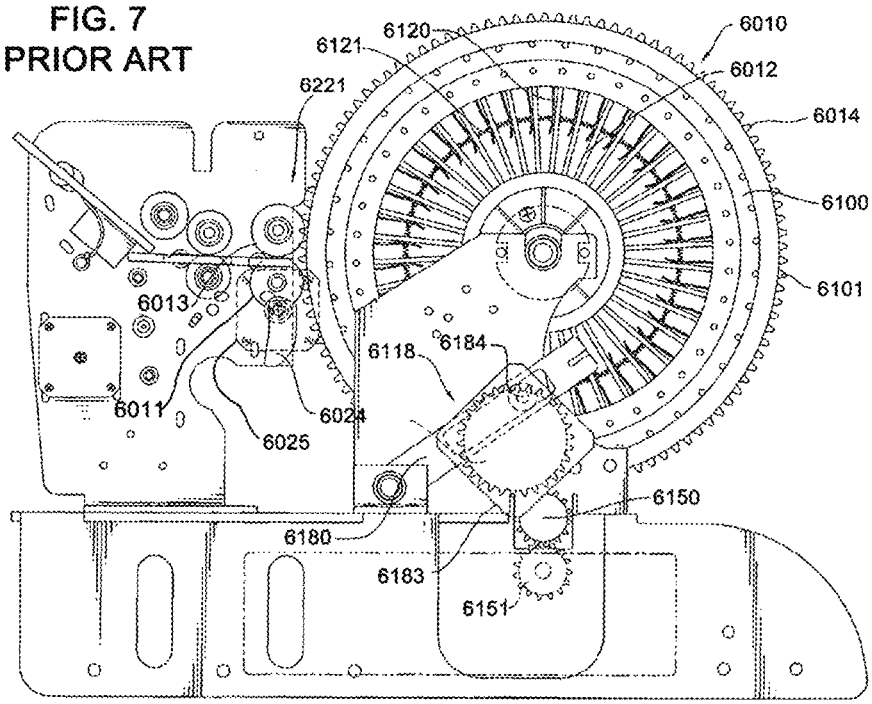
FIG. 7 PRIOR ART
FIG. 7 is a side elevation view from the prior art carousel shuffler patent disclosure in FIG. 6.
Figure 8:
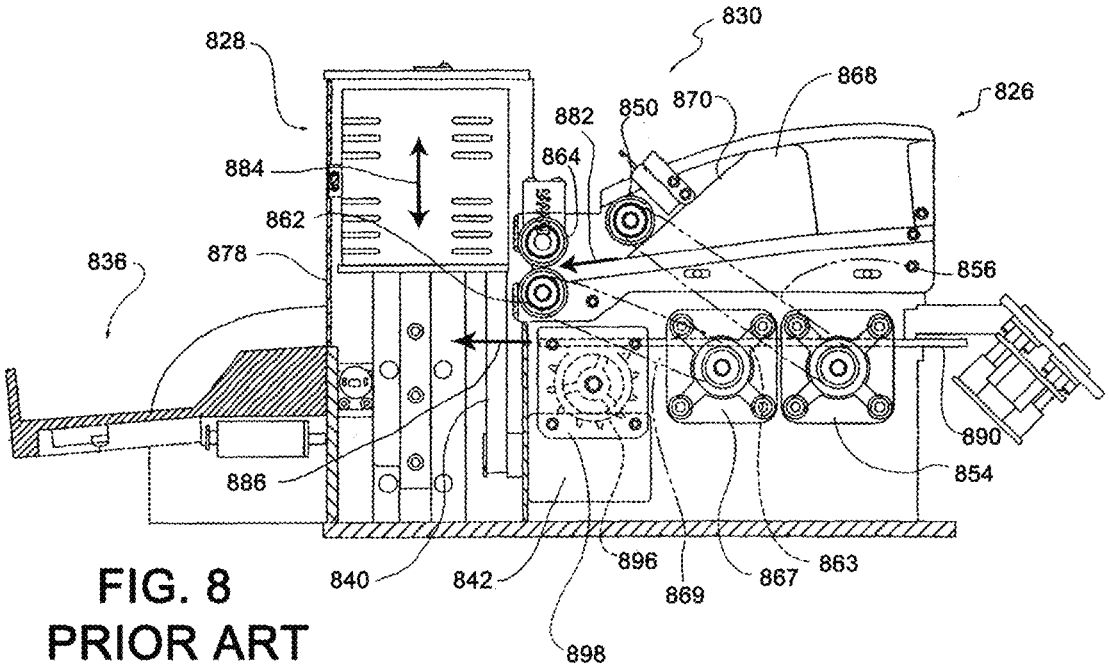
FIG. 8 PRIOR ART
FIG. 8 is a side elevation view from a prior art (2000) elevator shuffler patent disclosure.
Figure 9:
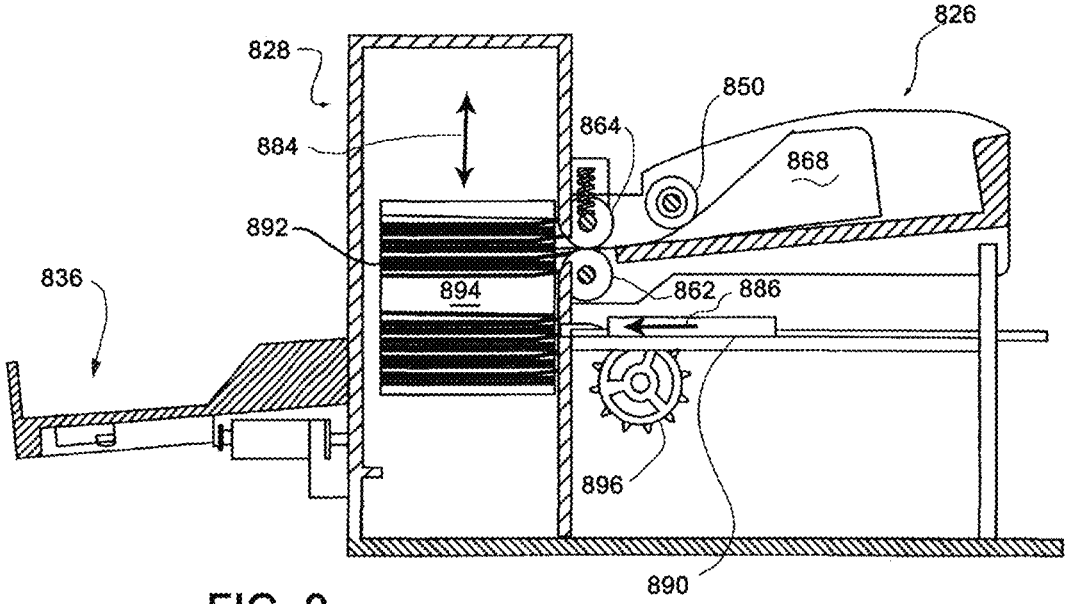
FIG. 9 PRIOR ART
FIG. 9 is another view from the prior art carousel shuffler patent disclosure in FIG. 8.
Figure 10:
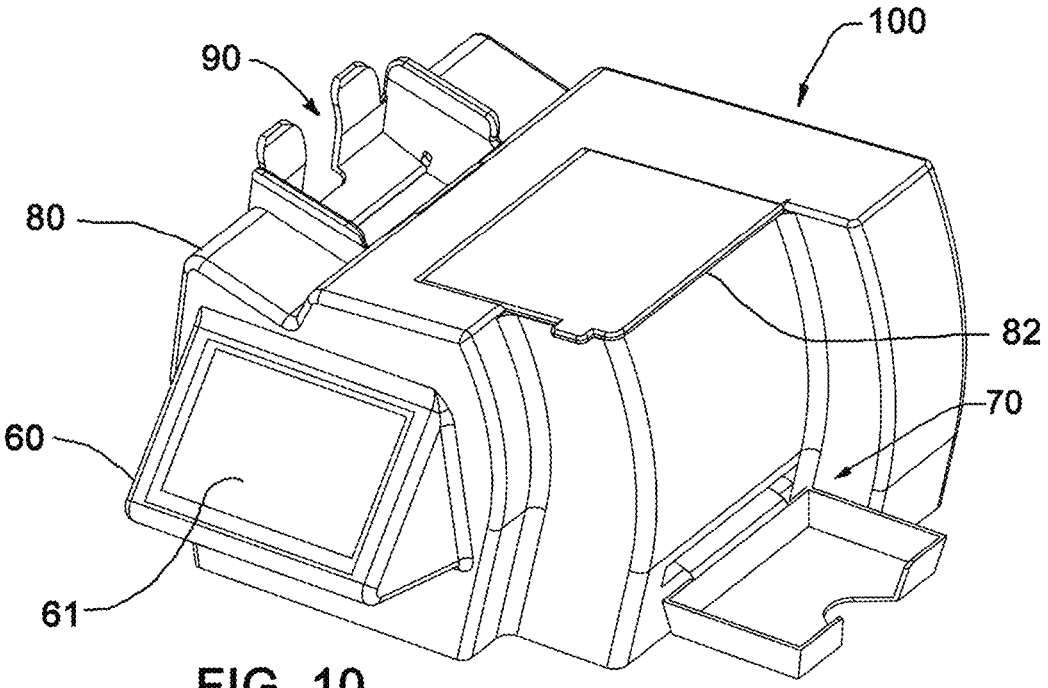
FIG. 10 is a perspective view of the preferred embodiment of the present invention as it would appear in a casino poker room.

FIG. 10 illustrates a preferred embodiment of the centrifugal shuffler device disclosed herein as it would appear in the poker room of a casino. The centrifugal shuffler 100 possesses a housing 80 and a control panel 60 which is positioned conveniently for a casino dealer on the exterior of the housing. At least one microcontroller 84 (not shown) controls the operation of the shuffler, including operation of the control panel. The control panel 60 includes a small 5-inch touchscreen 61 that is used to program the shuffler for various poker games. For size reference, a 5-inch touchscreen is slightly smaller than the smaller touchscreens used in today's mobile phones. Prior to each game, the dealer will utilize the touchscreen 61 of the control panel 60 to program the shuffler to produce the required number of cards in each hand as required by various forms of poker. Additionally, the dealer will program the shuffler 100 to issue N hands, where N is the number hands needed for the game. The touchscreen 61 will also indicate possible malfunctions and security issues to the dealer. For example, the microcontroller 84 counts the number of cards sorted in each deck and will issue a warning on the touchscreen 61 if that number is unexpected due to player or dealer cheating.

An input portal 90 is designed to receive and hold a deck of unshuffled cards. Upon dealer command, those cards are transported individually into a randomizing mechanism which possesses multiple nests, whereupon each nest is randomly filled with one hand of cards. The microcontroller utilizes a subroutine called a "random number generator" to generate a random address for selecting one of the eight nests for inserting each card as it is moved from the input portal 90. An indicator on the touchscreen 61 notifies the dealer when the nests are ready for distribution to the players. Thereafter, the dealer commands the shuffler to deliver shuffled (randomized) hands to the discharge portal 70. In one embodiment, the shuffler will automatically deliver a new hand to the discharge portal each time that a previous hand is removed. A cover 82 on the housing is used to access the internal mechanism for maintenance purposes and also for the case of experiencing an internal malfunction.

Figure 11:
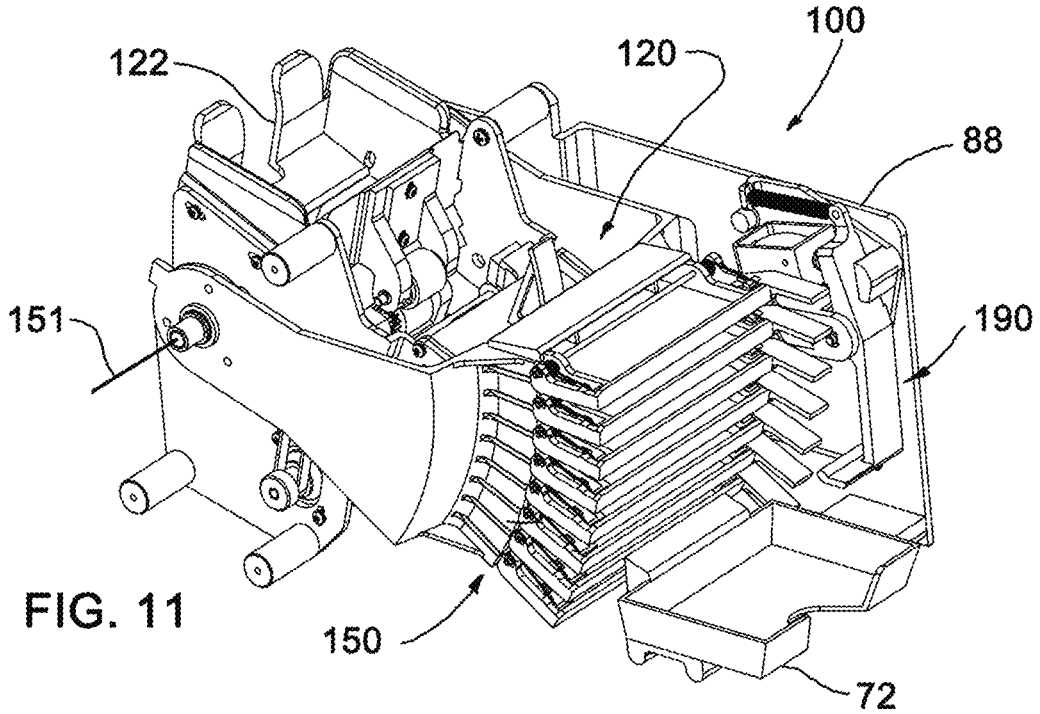
FIG. 11 is a perspective view of the preferred embodiment with its cover housing removed.

An overall view of the centrifugal shuffler's internal mechanisms is shown in FIG. 11 where the exterior housing and the nearest side frame are not shown in for the purpose of illustration. There are three major subassemblies shown in this figure, including the card transport 120, the radial receiver 150 and the interposer module 190. Briefly, the card transport 120 moves individual cards from the unshuffled card tray 122 and moves them individually into one of eight randomly selected nests within the radial receiver 150, which rotates about axis 151. When the nests have accumulated a sufficient number of cards to form a hand, the radial receiver 150 is rotated to discharge the contents of each nest (substack) into the discharge tray 72. The substacks are moved to the discharge tray 72 by centrifugal force after the interposer module 190 relieves the required nest retainer.

Figure 12:
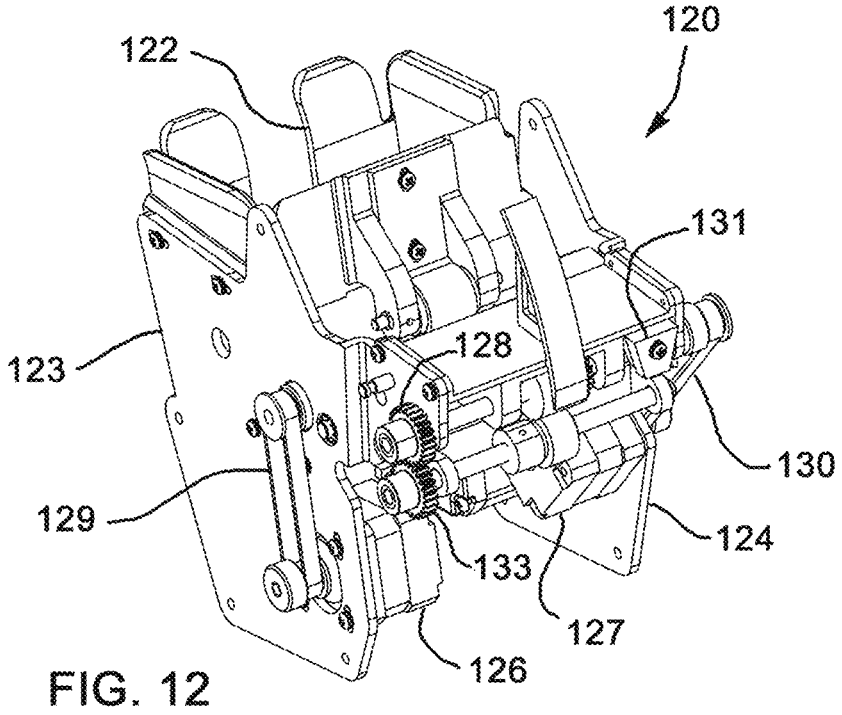
FIG. 12 is a perspective view of the card transport of the preferred embodiment when isolated from the apparatus.

An isometric view of the card transport assembly 120 is shown in FIG. 12. Individual cards are moved from the unshuffled card tray 122 and into the radial receiver 150 by two motors. A motor 126 rotates a set of stripper rollers via a timing belt 129 which removes one card at a time from the unshuffled stack. A motor 127 rotates a set of flick rollers via a timing belt 130 which accelerate each card into the nests within the radial receiver 150.

Figure 13:
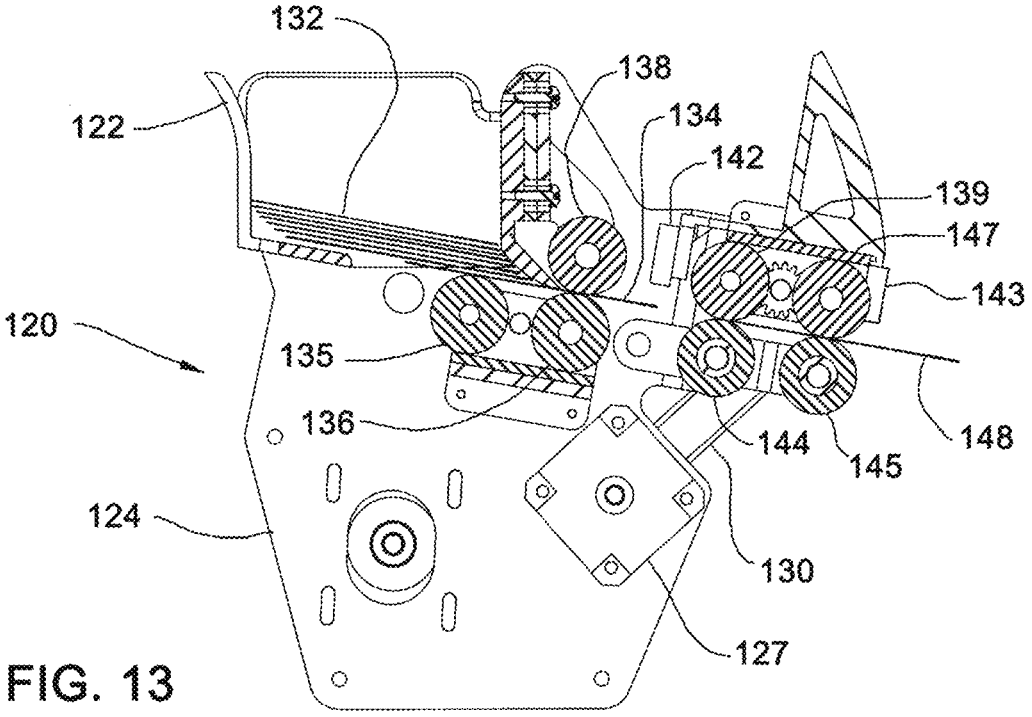
FIG. 13 is a side view of the card transport of FIG. 12.

FIG. 13 is a section view of the card transport 120 which shows a series of rubber covered transport rollers which illustrate the functionality of the two motors 126 and 127. A stack of cards 132 is shown in the unshuffled card tray 122 where the stack is partially supported by strip roller 135. Motor 126 rotates the strip rollers 135, 136 and 138 to "strip" individual cards from the bottom of stack 132 and transports each card until its edge is detected by optical sensor 142. If there exists a second card 148 ahead of card 134, then the strip motor temporarily ceases motion of card 134. The "card path" is defined as the axis defined by an imaginary line along the surfaces of cards 134 and 148.

The optical sensor 143 is utilized to detect the leading and trailing edge of card 148 which is engaged in the forward set of four rollers which are referred to as the "release rollers" 144, 145, 139 and 147. If the trailing card 134 is stopped, then motor 127 will move the leading card 148 with rapid acceleration into the nests of the radial receiver 150. When the trailing edge of card 148 is detected by optical sensor 143, both motors will activate to feed card 134 forward to the release rollers 139, 147, 144 and 145. Additionally, the optical sensor 143 is used by the microcontroller 84 to count the cards being inserted into each nest.

The microcontroller keeps track of the cumulative card count in each nest, and therefore "knows" when that nest is "ready". The definition of a "ready" nest is a nest that has accumulated the correct number of cards that correspond to the size of the hand that is programmed for the game underway. When a nest achieves the "ready" state, the microcontroller no longer directs cards to that nest. After N nests achieve the ready state (N=number required hands), the shuffler 100 will utilize the touchscreen 61 to indicate that the required hands are fully formed within the device and available for discharge upon dealer demand. Alternately, the shuffler 100 may be programmed to automatically deliver the first hand to the discharge tray 72 immediately after any nest achieves the ready state.

Once the newly moved card enters into the forward release rollers (FIG. 13), it will be stopped when its leading edge is detected by optical sensor 143. That card will remain in that state until a randomly selected nest within radial receiver 150 becomes positioned to receive it. After accelerating the forward card from the release rollers into the radial receiver 150, the transport cycle of motors 126 and 127 will be repeated simultaneously with the rotation of the radial receiver 150 to its next insertion position.

Figure 14:
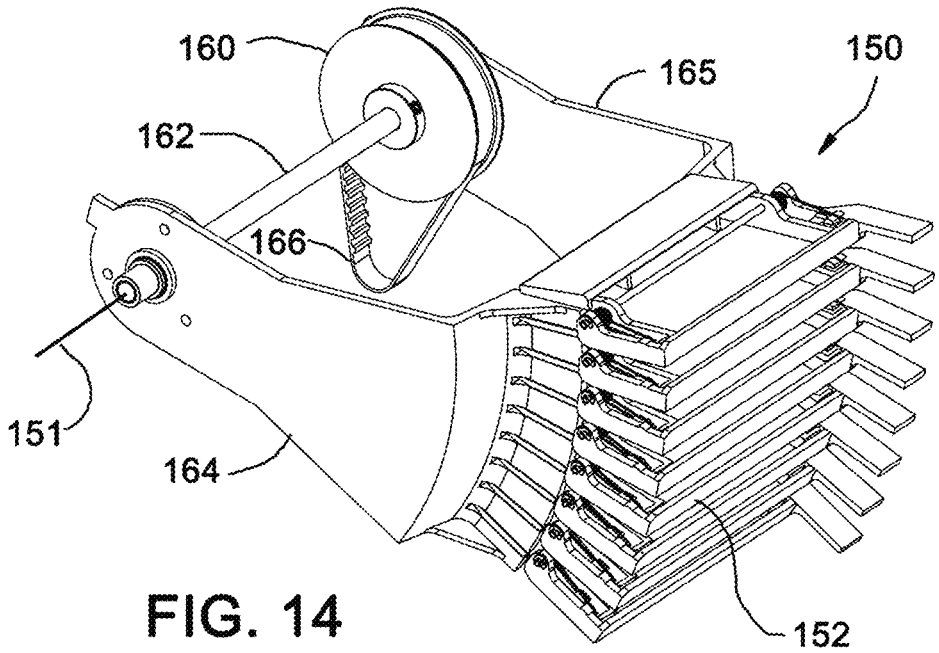
FIG. 14 is a perspective view of the radial receiver of the preferred embodiment.

An isometric view of radial receiver 150 is shown in FIG. 14 where this assembly is isolated from the overall mechanism shown in FIG. 11. The radial receiver 150 comprises eight (8) nests 152 which are radially mounted to carrier arms 164 and 165. The entire assembly rotates about axis 151 and is rotationally driven by a radial receiver drive motor 167 (not shown). The drive motor 167 is connected to the radial receiver arm 165 by timing belt 166 and pulley 160 which is rigidly attached to arm 165. Angular motion of the entire assembly 150 is controlled by the microcontroller 84. The microcontroller 84 and drive motor 167 together are capable of rotating the radial receiver 150 with angular precision and with significant angular acceleration while positioning any one of the eight nests into radial alignment with the card path of the card transport 120.

Figure 15:
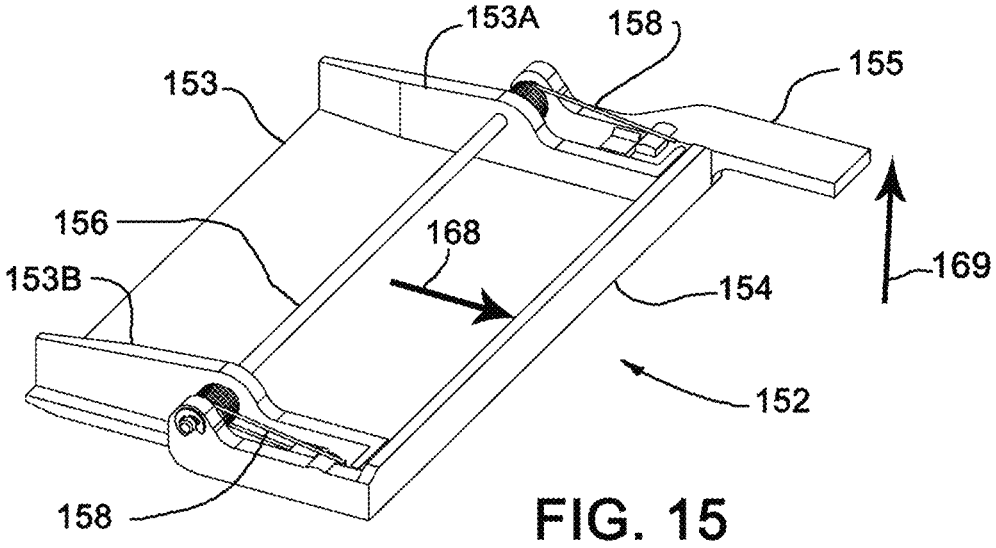
FIG. 15 is a perspective view of the card substack nest of the preferred embodiment.

A single nest 152 is shown isolated in the perspective view of FIG. 15 and comprises a nest base 153 and a movable retainer 154, which are both made of injection molded plastics. Card substacks are retained within the nests laterally by the walls 153A and 153B. The card substacks are retained along the direction of arrow 168 by the retainer 154, where arrow 168 represents the direction of the centrifugal force. Movement against actuation arm 155 in the a direction of the arrow 169 induces retainer 154 to pivot about a stainless steel pin 156 which functions as the retainer's axle. Two torsion springs 158 hold retainer 154 in the position shown during the operational procedures utilized for distributing random cards to the nests. The edges of the accumulated card substacks are forced against the internal edge of the retainer 154 in the direction of the arrow 168 by centrifugal force during rotational motion of the radial receiver 150. The centrifugal force acts in a beneficial manner to retain and align the edges of the substacks during the rotational excursions of radial receiver 150.

Figure 16:
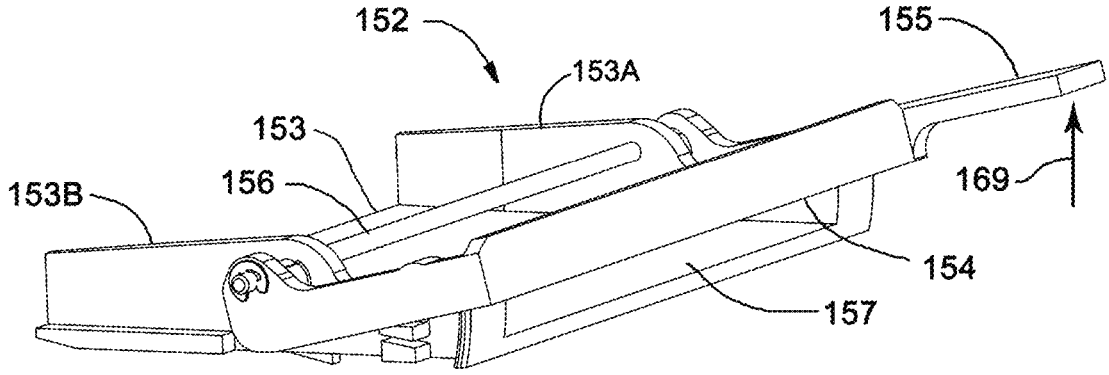
FIG. 16 is another perspective view of the of the card substack nest of the preferred embodiment.

FIG. 16 illustrates the state where the retainer 154 is pivoted to a displaced position, creating an exit orifice 157 which allows the card substacks to escape from the nest 152. The exit orifice is temporarily created by an actuating force that contacts actuation arm 155 in the direction of arrow 169. Movement of arm 155 pivots the retainer 154 about pin 156 against the restoring action of torsion springs 158, thus creating the exit orifice 157. In comparison to the cost of a stepper motor, the torsion springs, steel pins and injection-molded shutters cost pennies in high volume.

Figure 17:
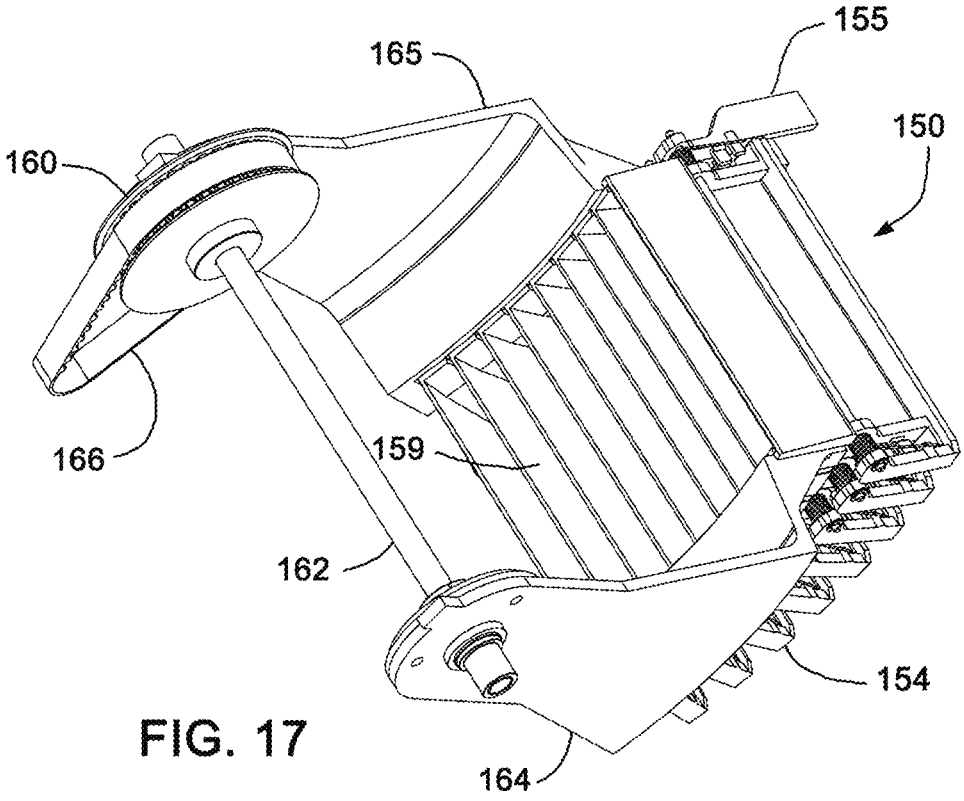
FIG. 17 is a perspective view of the radial receiver assembly of the preferred embodiment.

The entrance orifices 159 to the nests 152 are shown in FIG. 17. This view illustrates the internal nest orifices which are each randomly aligned with the card path of card transport 120 for moving cards individually into the nests 152. Each nest has a capacity of 27 cards which is slightly more than one-half of a card deck. However, the maximum expected hand size is 7 cards in the case of seven card stud poker. The oversize nests guarantee that the card substacks will always be retained loosely within the nests. While the exit orifice 157 (FIG. 16) is sized to allow 27 cards to escape, the entrance orifice of each nest is larger, with an equivalent size of 36 cards. Thus, one characteristic of the preferred embodiment is the distinction that the entrance orifice of each nest is significantly larger than the exit orifice.

A side elevational section view of the preferred embodiment is shown in FIG. 18. Radial receiver 150 has been rotated about its axle 162 to align a nest (third from bottom) with the card path of the card transport 120. The leading edge of a card 148 is shown entering into the third nest from the bottom of the radial receiver 150. That card is being propelled with acceleration by the release rollers 139, 147, 144 and 145. Each nest base 153 possesses a deflection fin 167 on its lower side, which functions to deflect cards underneath the pivot pin 156. The distance from the floor of nest 153 to the tip of the fin 167 establishes the nest capacity of 27 cards.

Card 134 in FIG. 18 has been advanced until its leading edge is detected by optical sensor 142. It is said to be queued and ready to advance into the release rollers when card 148 enters its target nest. After the trailing edge of card 148 passes the forward sensor 143 (see FIG. 13), the radial receiver 150 will rotate to its next random nest position as directed by the random number generator in the microcontroller 84. Simultaneously, the card 134 will advance into the release rollers until detected by forward sensor 143 (see FIG. 13).

Centrifugal force moves the substacks from the individual nests of the radial receiver 150 to the discharge tray 72 after enabling the interposer module 190. Referring to FIG. 19, the interposer module 190 is mounted laterally from the nests and is shown mounted to the rear side frame. FIG. 20A and FIG. 20B explain the operation of the interposer.

Referring to FIG. 20A, the interposer module 190 is shown in isolation. The module consists of an interposer arm 192, a pivot pin 195, an open frame solenoid 193, a return spring 196 and an injection molded mounting plate 194. The open frame solenoid is chosen as the actuator because of its economy, having a cost about ⅓rd that of a stepper motor. The interposer 192 is an injection molded component which possesses an actuation finger 197 at its lower extremity. The solenoid is not activated in FIG. 20A and the return spring 196 is holding the interposer arm 192 in the position shown, which is called the interposer rest position. In FIG. 20B, the solenoid 193 has been actuated by a voltage pulse which causes the interposer arm 192 to rotate clockwise about pin 195, moving the interposer finger 197 in the direction of arrow 198. Rotation of the interposer is stopped by projection 199 which is an integral part of the mounting plate 194. This state is called the interposer actuated position.

The interposer arm 192 is used to enable the movement of any of the movable retainers 154 by intercepting the path of any of the eight actuation arms 155. Referring to FIG. 18, the interposer 192 is shown in its rest position where it is unable to engage the path of the arms 155.

Referring to FIG. 21, the interposer is shown in the actuated position and the radial receiver 150 has been rotated about axle 162 to a "pre-launch" position prior to launching substack 180 into discharge tray 72. Discharge tray 72 possesses an optical sensor 182 in its base which is used to detect the presence of cards. If no cards are present, the shuffler 100 is ready to launch the substack 180. The radial receiver 150 has been momentarily stopped while the interposer finger 197 is injected into the path of the 3rd nest from the top and is in a position to intercept arm 155 of that nest when the radial receiver 150 rotates clockwise. FIG. 21 thus illustrates the "pre-launch" state of the shuffler 100 when it is about to move card substack 180 into the discharge tray 72.

Figure 22:
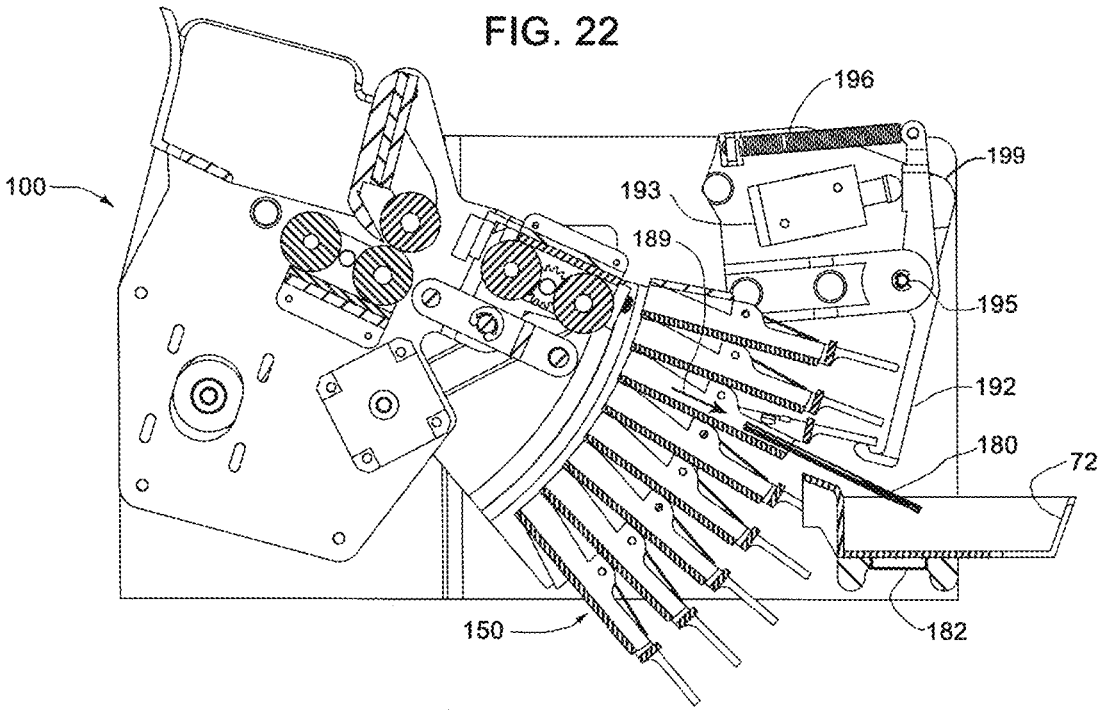
FIG. 22 is a side elevation view showing a card substack being launched into the output tray.

While interposer 192 is held in this actuated position (FIG. 21), the radial receiver 150 is thereafter rapidly rotated clockwise and rapidly stopped at the card delivery position as shown in FIG. 22. The deceleration causes centrifugal force to rapidly discharge the substack 180 into the discharge tray 72 while the moveable retainer 154 is restrained. Arrow 189 indicates the direction of the centrifugal force as the radial receiver 150 reaches its terminal clockwise destination. After a momentary pause, the radial receiver 150 is returned counterclockwise to the "pre-launch" position and the solenoid 193 is deenergized, allowing the interposer spring 196 to extract the interposer finger 197 from the path of actuator arms 155. The centrifugal shuffler 100 is then ready to move a shuffled (randomized) substack from another nest 152 to the discharge tray 72.

In comparison to the prior art, the movement of the substack during discharge is slightly more than the equivalent of one card width in the preferred embodiment. The discharge movement of the pusher devices in the prior art is substantially longer, thus requiring more time. In addition, the pusher mechanisms need a retraction stroke to restore the pusher which doubles the time for pusher movement. In this way, the preferred embodiment can discharge the substacks to the output tray more rapidly than the cited art.

Once delivered to the discharge tray 72, the shuffler randomly positions another nest of the radial receiver 150 to the "pre-launch" position and actuates the interposer 192. If the sensor 182 indicates that the discharge tray 72 is empty, then the next launch cycle can be initiated. In one programmable operating mode, the next cycle is initiated by the dealer via the touchscreen 61. In an alternate programmable operating mode, the shuffler automatically disgorges the next hand when the sensor 182 indicates that the dealer has removed a hand. The disgorgement cycle repeats until all of the required hands are delivered to discharge tray 72.

In an alternate, but less advantageous embodiment, the radial receiver 150 may be rotated slowly to a state wherein the card substacks are moved to the discharge tray 72 solely by gravity, rather than by centrifugal force. In this alternate embodiment, the card receiver rotates slowly to disgorge each nest substack after the interposer 192 has intercepted the moveable retainer 154. As the radial receiver 150 approaches the aligned position, the card substack thereafter slides into the discharge tray 72 by gravity.

After the hands have been distributed to all players, there are various amounts of cards left in the nests and in the unshuffled card portal. For example, for certain 7-card stud games such as "Rollover" or "Baseball", each hand consists of seven cards which are delivered to each player, and no additional cards are needed for that game. If there are five players, then thirty-five (35) cards will have been dealt, leaving seventeen (17) cards within the shuffler. Some of these residual cards will have been delivered to unfilled nests and some will remain within the unshuffled card tray 122. Comparatively, a game of Three-Card Poker® with five players will only utilize eighteen (18) cards (five player hands and one dealer hand). In this latter case, the majority of cards will remain unplayed and the dealer will purge the shuffler of these residual cards before starting a new game. This process is called the purging cycle.

While forming hands, the microcontroller tracks the number of cards moving into and out of each nest, and "knows" how many residual cards remain in each nest, if any, at the end of each poker game. Within the purging cycle, the microcontroller rotates each non-empty nest appropriately to unload the residual substacks into the discharge tray 72. However, the microcontroller does not "know" the number of cards remaining in the unshuffled card portal.

Figure 23:
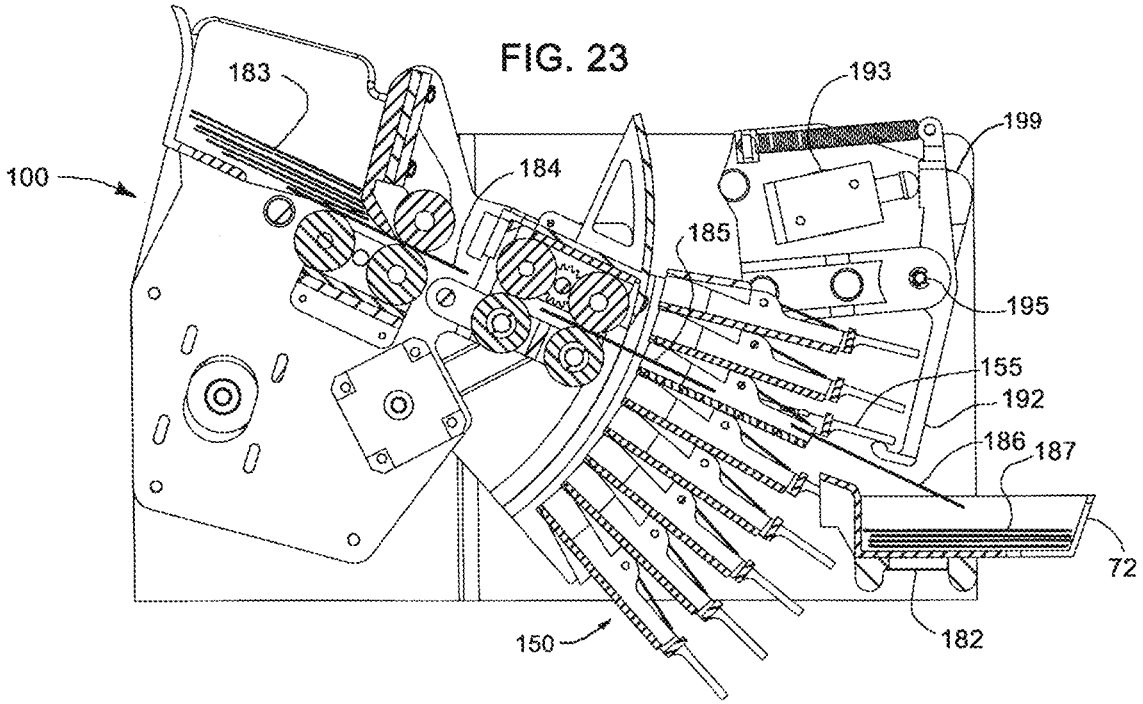
FIG. 23 is a side elevation view showing individual cards being purged from the input portal.

The dealer has options in regard to purging those cards remaining in the unshuffled card portal. In one embodiment, the dealer may program the centrifugal shuffler 100 to sort the cards remaining in the unshuffled card portal into the nests, and thereafter deliver them to the discharge tray 72. In another embodiment, the dealer may program the centrifugal shuffler to rapidly deliver the unshuffled cards directly from the unshuffled card portal to the shuffled card portal. This latter option is accomplished by aligning any nest within the radial receiver 150 with the path of the card transport as shown in FIG. 23, such that individual cards may be rapidly moved to the discharge tray 72 without requiring temporary storage within the radial receiver 150. An optical sensor (not shown) located in the floor of the unshuffled card portal alerts the microcontroller when no cards remain, and the optical sensor 143 will have finished its card count when the unshuffled card portal is empty.

At the termination of the purging cycle, the microcontroller will display the card count on the touchscreen 61. If the count is unexpected, as for example from cheating by a player or dealer, then an error message and warning will be signaled to the dealer such as by a flashing visual indicator or audible warning. In this way, the deck size may be properly validated before commencing the next game.

Figure 24:
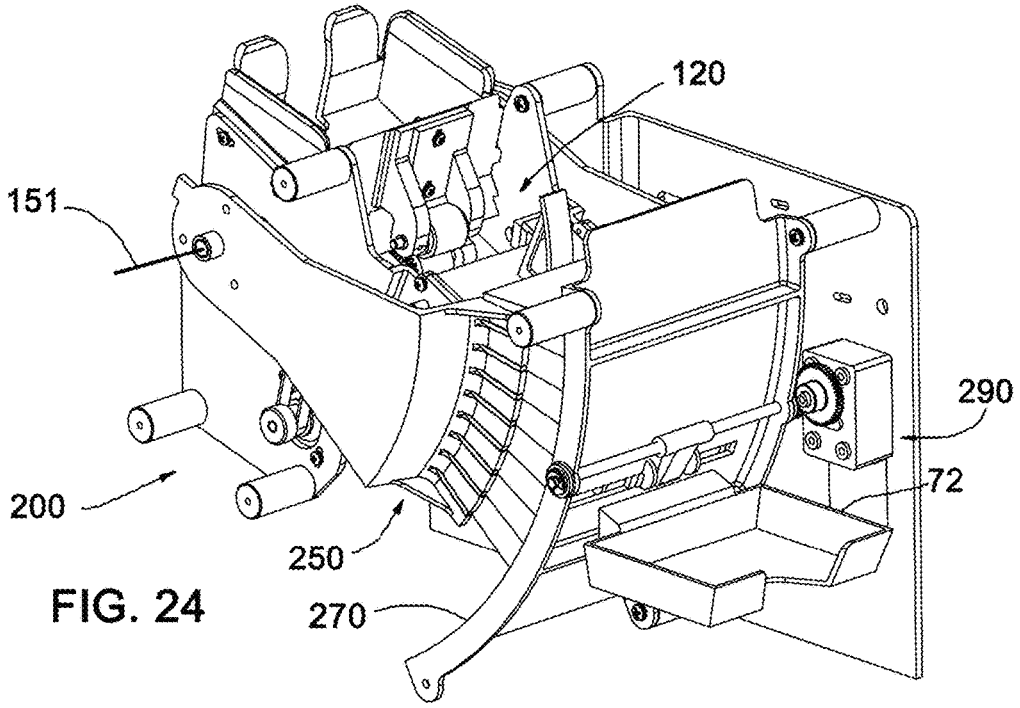
FIG. 24 is a perspective view of a second embodiment of the centrifugal shuffler.

A second embodiment of the centrifugal shuffler utilizes a stationary retainer and a single moveable shutter to facilitate the centrifugal launch of substacks into the discharge tray 72. FIG. 24 illustrates a perspective view of the shuffler 200 with radial receiver 250, stationary retainer 270 and moveable shutter assembly 290. The card transport 120 and the discharge tray 72 are the same components as utilized in the preferred embodiment. The outer casing and nearest side frame have been removed in this figure in order to reveal the interior components.

Figure 25A:
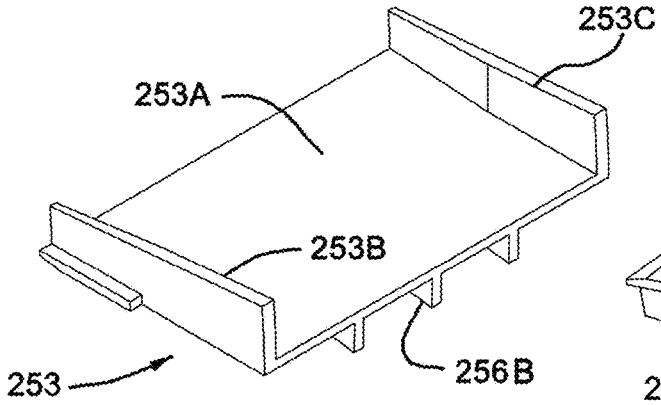
FIG. 25A is a perspective view of the second embodiment nest.
Figure 25B:
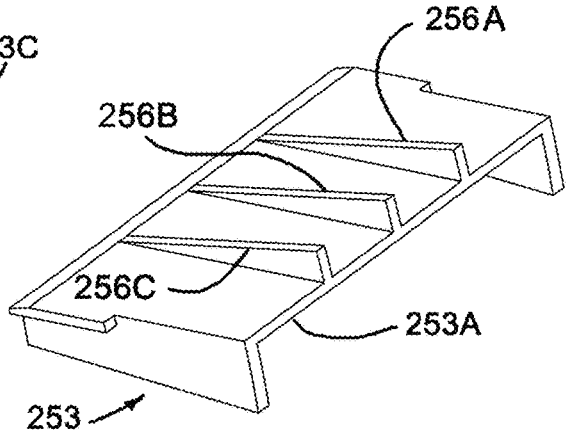
FIG. 25B is another perspective view of the second embodiment nest.
Figure 26:
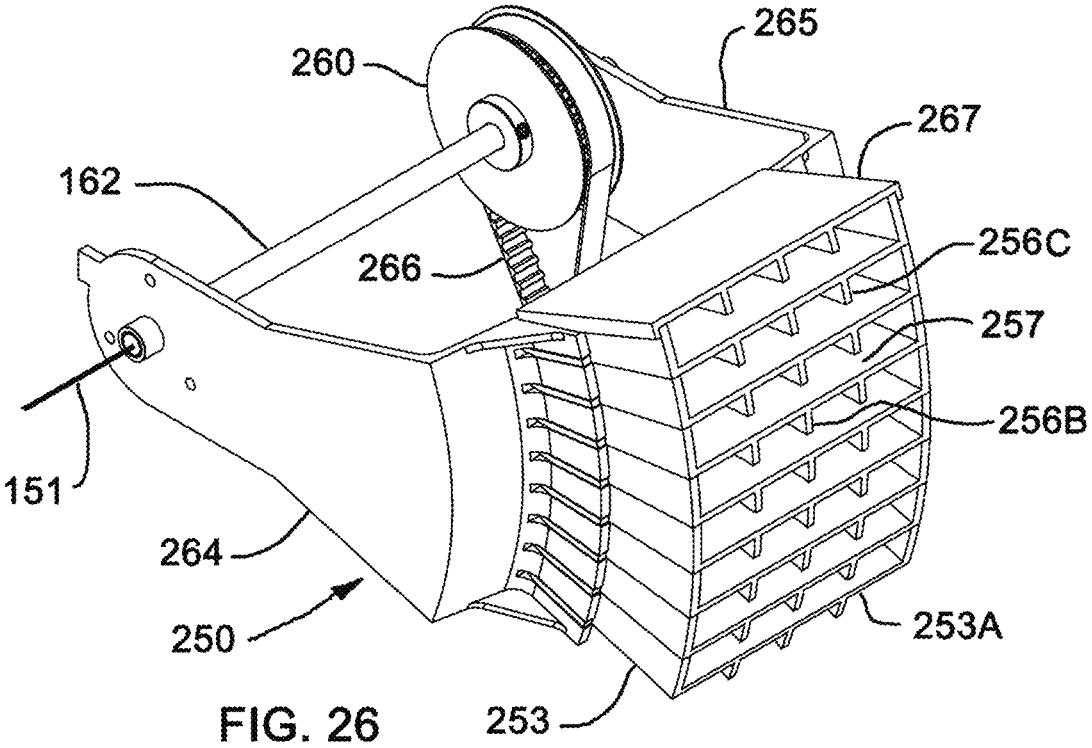
FIG. 26 is a perspective view of the radial receiver of the second embodiment.

The radial receiver 250 in this embodiment is similar to the radial receiver 150 in the preferred embodiment and pivots about the same axis 151. However, in this embodiment the nests in the radial receiver 250 are designed differently than in the preferred embodiment. FIG. 25A and FIG. 25B show two views of a single injection molded nest 253. The card substacks are laterally contained by walls 253B and 253C, and rest upon surface 253A in FIG. 25A. The opposite side of the nest wall 253A possesses three identical angular fins 256A, 256B and 256C which are used to funnel the card stacks to the exit orifice of each nest, as shown in FIG. 25B. FIG. 26 illustrates the positions of the angular fins 256A, 256B and 256C in an isolated perspective view of the radial receiver 250.

Figure 27:
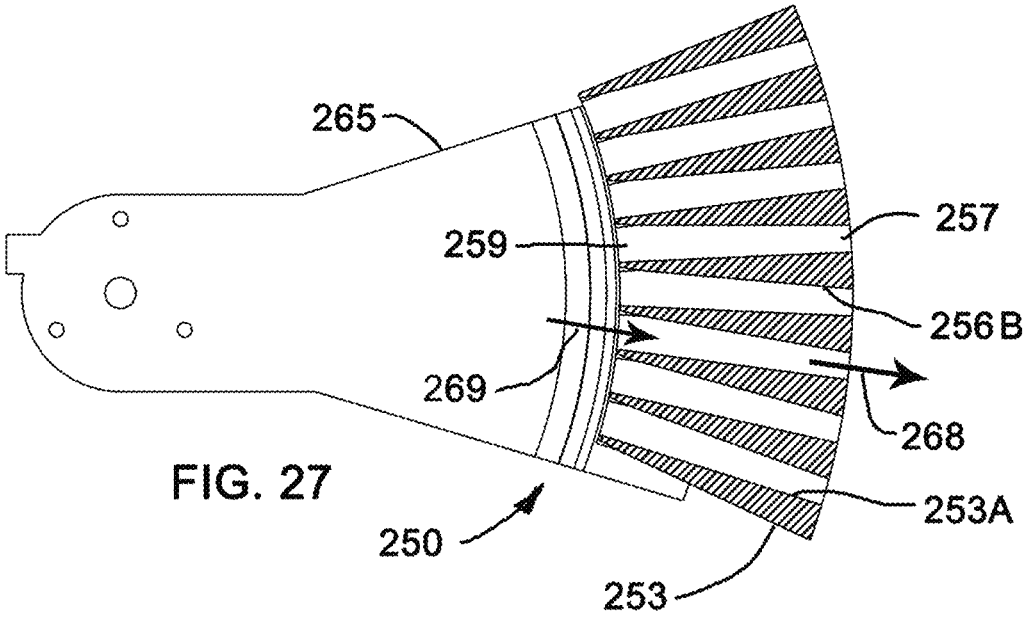
FIG. 27 is a section view of the radial receiver of the second embodiment.

A side elevation section view of the radial receiver 250, as shown in FIG. 27, illustrates the tapered shape of each nest whereupon the exit orifice is smaller than the entrance orifice. This section view is taken in a plane that is parallel to the arm 265 and perpendicular to the axle axis 151. The section is taken through the center of the radial receiver 250 which corresponds with the center of fin 256B. The entrance orifice 259 to each nest is sized equivalently to the thickness of thirty-six (36) playing cards, while the exit orifice 257 is sized equivalently to the approximate thickness of twenty (20) playing cards. Since the maximum substack size is seven cards (7 card stud hand), the oversized nest capacity guarantees that the substacks will be loosely retained in each nest. The arrow 269 and arrow 268 indicate the direction that the cards enter and exit each nest. Both the entrance and exit directions are in the same direction as the centrifugal force.

Figure 28:
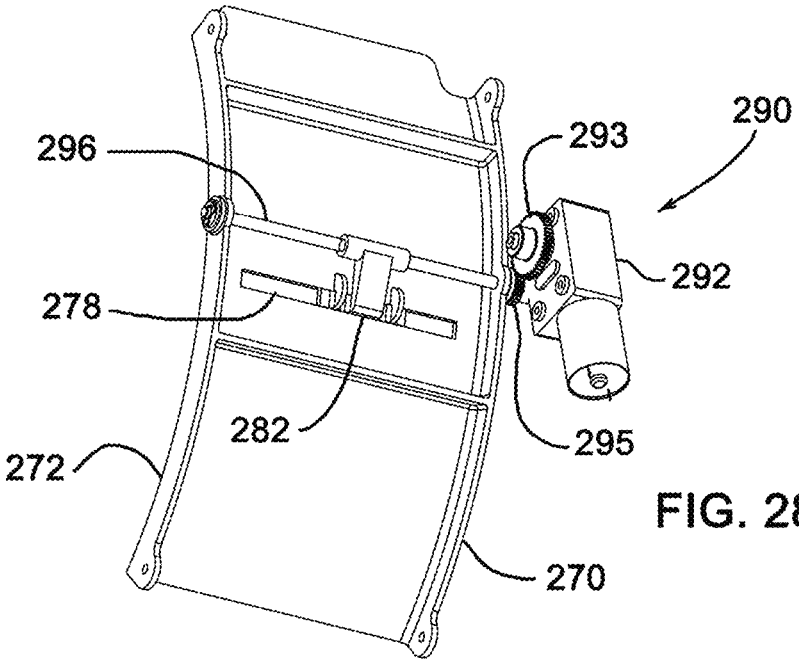
FIG. 28 is a perspective view of the shutter mechanism of the second embodiment.

FIG. 28 shows a view of the shutter mechanism 290 and its relationship to the retainer 270. The retainer has an internal radial surface 272 which is concentric to the axle of the radial receiver 250. A gap 274 exits between the radial extremities of the radial receiver 250 and the internal surface 272, which allows the card substacks to protrude slightly from the nests 253 and bear upon the surface 272. During rotation of the radial receiver 250, centrifugal forces induce the edges of the cards to contact surface 272, thus aligning the edges of each card in the substack.

Cards are moved by centrifugal force from the nests 253 to the discharge tray 72 through a slit 278 in the retainer 270. A rotating shutter 282 is normally located within the slit 278 as shown in that figure. The interior surface of the shutter matches the radius of the interior surface 272 of the retainer 270 and is flush with that surface when in the normal position of closing off the slit. The slit 278 is sized slightly larger than the exit orifice 257 of the nest 253.

Referring to FIG. 28, the rotating shutter is operated by a DC motor/gearbox actuator 292 which is mounted to the far side frame 210. A gear 293 on the actuator shaft of the DC motor/gearbox rotates pinon 295 on the end of shaft 296. Both the shutter 282 and the pinion 295 are rigidly attached to the shaft 296, such that the shutter 282 and the pinion 295 rotate synchronously. A small trickle current applied to the DC motor is used to hold the shutter 282 in the closed state. Rotation of the gear 293 clockwise causes the shutter 282 to rotate counterclockwise, thus allowing a properly positioned card substack to escape through the slit 278.

Figure 29:
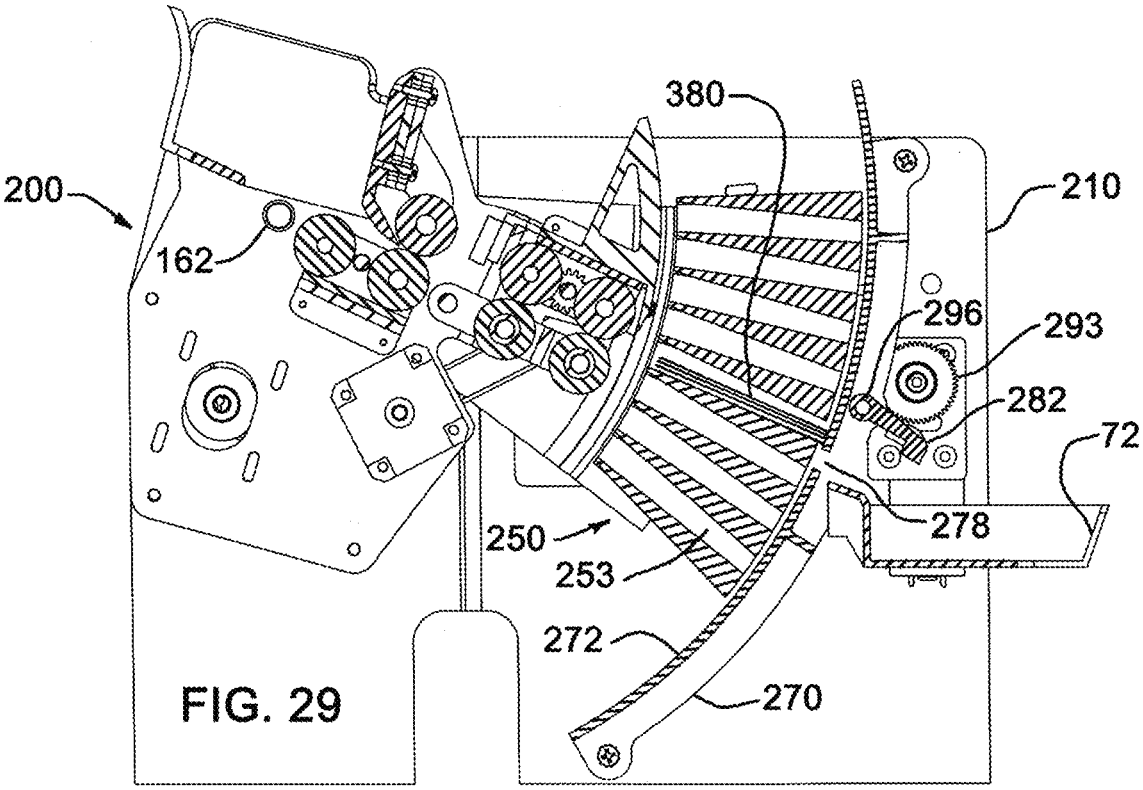
FIG. 29 is a section view showing the second embodiment in its "pre-launch" state.

This embodiment has a "pre-launch" state in a similar manner as was described in the preferred embodiment. Referring to FIG. 29, the shutter 282 is shown in the actuated position and the radial receiver 250 has been rotated about axle 162 to a "pre-launch" position prior to launching substack 380 into discharge tray 72. The edges of substack 380 are resting against the surface 272 of retainer 270. Discharge tray 72 possesses an optical sensor 182 (not shown) in its base which is used to detect the presence of cards. If no cards are present, the shuffler 200 is ready to launch the substack 380. The radial receiver 250 has been momentarily stopped while the shutter 282 was moved to the actuated position. For clarity, only one substack 380 is shown in the radial receiver 250. A closer view of the "pre-launch" position is shown in FIG. 30.

Figure 30:
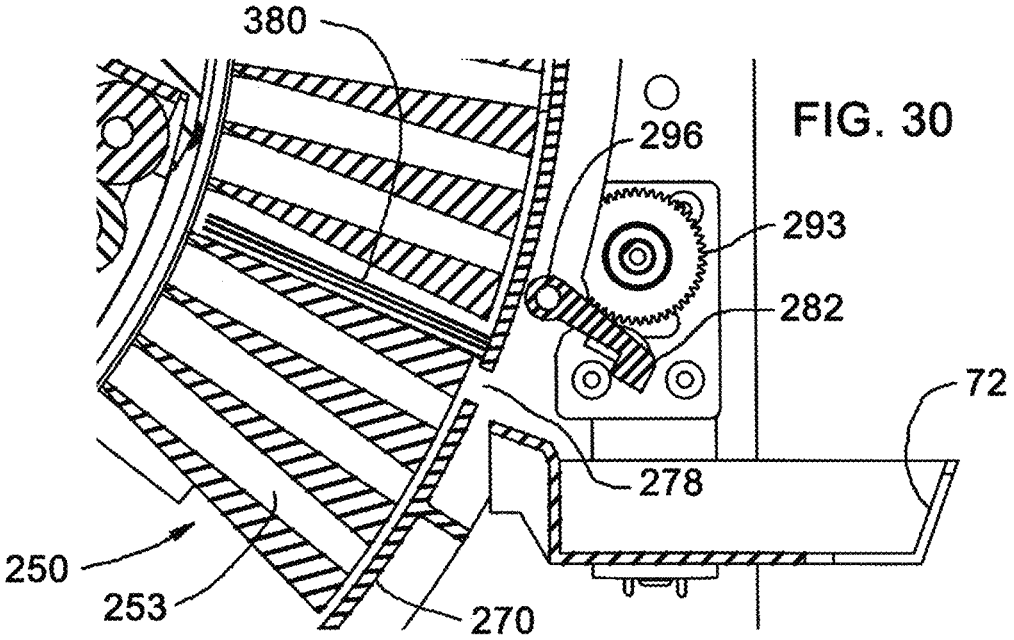
FIG. 30 is another section view of the second embodiment in its "pre-launch" state.
Figure 31:
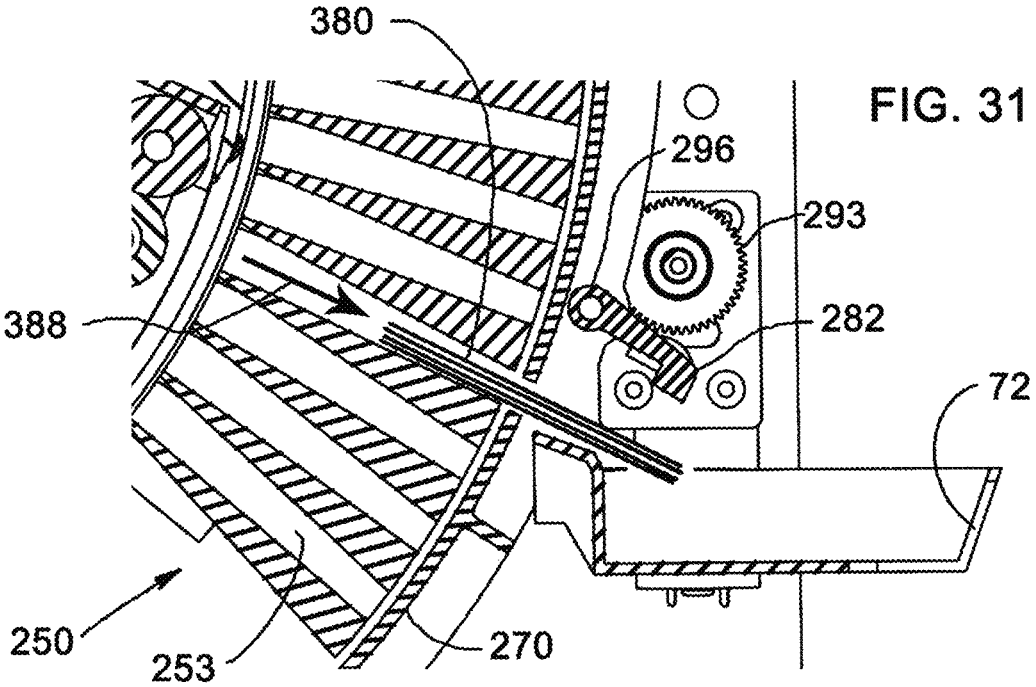
FIG. 31 is a section view of the second embodiment showing a card substack being launched into the output tray.

FIG. 30 and FIG. 31 together illustrate the centrifugal discharge of the substack 380 from its nest in the radial receiver 250. FIG. 30 shows the "pre-launch" condition as described above. While shutter 282 is held in this actuated position, the radial receiver 250 is thereafter rapidly rotated clockwise and rapidly stopped at the card delivery position as shown in FIG. 31. The rapid deceleration causes centrifugal force to discharge the substack 380 into the discharge tray 72 while the shutter 282 remains actuated. Arrow 388 indicates the direction of the centrifugal force as the radial receiver 250 reaches its terminal clockwise destination. After a momentary pause, the radial receiver 250 is returned counterclockwise to the "pre-launch" position and the shutter 282 is returned to the closed position as shown in FIG. 28. The centrifugal shuffler 200 is thereafter ready to move a shuffled (randomized) substack from another nest 253 to the discharge tray 72.

Once delivered to the discharge tray 72, the shuffler 200 randomly positions another nest of the radial receiver 250 to its "pre-launch" position and actuates the shutter 282. If the sensor 182 indicates that the discharge tray 72 is empty, then the next launch cycle can be initiated. In one programmable operating mode, the next cycle is initiated by the dealer via the touchscreen 61. In an alternate programmable operating mode, the shuffler automatically disgorges the next hand when the sensor 182 indicates that the dealer has removed a hand. The discharge cycle repeats until all of the required hands are delivered to discharge tray 72.

In an alternate, but less advantageous embodiment, the radial receiver 250 may be rotated to a state wherein the card substacks are moved to the discharge tray 72 solely by gravity, rather than by centrifugal force. In that alternate embodiment, the radial receiver 250 rotates to directly align each nest substack with the slit 278. The shutter 282 is thereafter rotated to the actuated position, allowing the substacks to slide by gravity into the discharge tray 72.

Figure 32:
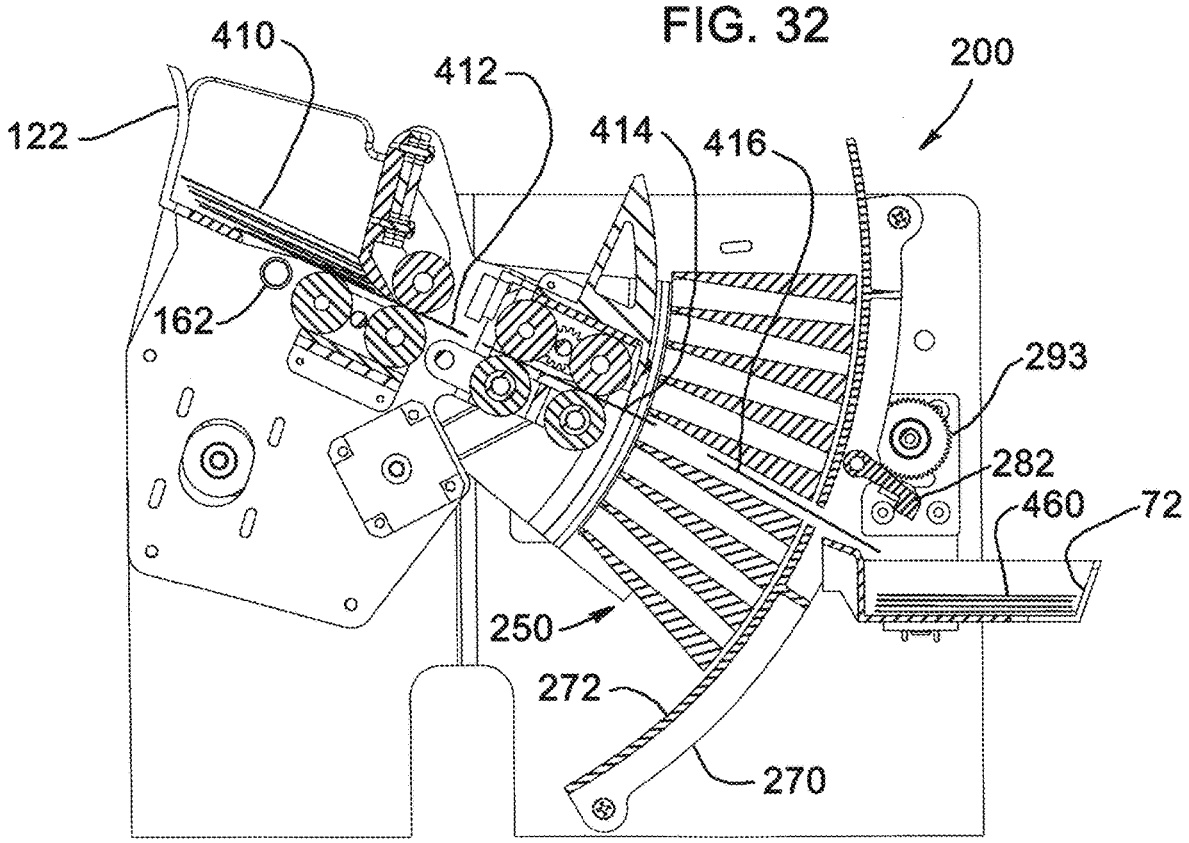
FIG. 32 is a section view of the second embodiment showing individual cards being purged from the input portal.

The purging cycle for the second embodiment is the same as described above for the preferred embodiment. The radial receiver 250 may be positioned to provide a direct path for rapidly moving cards from the unshuffled card portal to the discharge tray 72. During this portion of the purging cycle, any nest 253 can be aligned with both the card path and the slit 278 while the shutter 282 is held in the actuated position as shown in FIG. 32. Referring to FIG. 32, individual cards 412, 414, and 416 are being rapidly moved directly from the residual card stack 410 to the card stack shown as 460 in the discharge tray 72, without requiring any movement of the radial receiver 250. As with the preferred embodiment, the purging cycle of the shuffler 200 is utilized by the microcontroller 84 to validate the deck count.

Product improvement goals are met when a product redesign effort yields a new product that is smaller, cheaper or faster. The centrifugal shuffler designs as described herein achieve all three of these goals in comparison to the referenced Prior Art. The centrifugal shufflers are more compact (smaller) because they utilize fewer compartments. Manufacturing cost is reduced (cheaper) by elimination of the motor-driven pusher mechanisms and the electronic infrastructure associated with each motor. The centrifugal shufflers are faster because they utilize smaller, quicker excursions while delivering formed hands or residual cards to the output portal.

One of ordinary skill, having designer's choice, may choose to utilize different forms of actuators and transport components as described herein. Other forms of transport components, including cables, gears, chains and other types of belts may substituted for those described herein. Other types of motors and solenoids are also logical substitutions. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handing device for shuffling playing cards in a casino comprising:

a housing;

a control panel positioned on the exterior of the housing;

an unshuffled card input portal consisting of a single card receiving cavity;

a shuffled card discharge portal consisting of a single card discharge cavity;

a rotatable card receiver having a plurality of radially-arranged card storage nests which rotate about a common axis;

each nest having an exit orifice and an entrance orifice;

each nest holding a plurality of cards;

at least one microcontroller responsive to the control panel;

a motor that rotates the card receiver incrementally and bidirectionally amongst the radially arranged nests while producing centrifugal force;

a card transport that moves cards from the input portal to the rotatable card receiver in the direction of the centrifugal force;

at least one retainer that retains cards within the rotatable card receiver in opposition to centrifugal force;

card substacks within each nest being aligned by the retainer; and wherein the card handing device moves cards into the nests and out of the nests in the same centrifugal force direction; and wherein the card handing device moves the card substacks from the nests to the output portal by centrifugal force; and wherein the card handing device has at least one direct path operable to convey individual cards directly from the input portal to the discharge portal.

2. The card handling device of claim 1 that signals an error condition upon card count deviation from a previously programmed parameter.

3. A card handing device for shuffling playing cards in a casino comprising:

a housing;

a control panel positioned on the exterior of the housing;

an unshuffled card input portal consisting of a single card receiving cavity;

a shuffled card discharge portal consisting of a single card discharge cavity;

a rotatable card receiver having a plurality of radially-arranged card storage nests;

the plurality of nests all rotating about a common axis;

each nest having an exit orifice and an entrance orifice;

each nest holding a plurality of cards;

at least one microcontroller responsive to the control panel;

a motor that rotates the card receiver incrementally and bidirectionally amongst the radially arranged nests while producing a centrifugal force;

a card transport that moves cards from the input portal to the rotatable card receiver in the direction of the centrifugal force;

at least one retainer that retains cards within the rotatable card receiver in opposition to centrifugal force;

card substacks within each nest being aligned by the retainer; and wherein the card handing device moves cards into the nests and out of the nests in the same centrifugal force direction; and wherein the card handing device moves the card substacks from the nests to the output portal solely by gravity; and wherein the card handing device has at least one direct path operable to convey individual cards directly from the input portal to the discharge portal.

4. The card handling device of claim 3 that signals an error condition upon card count deviation from a previously programmed parameter.

* * * * *